US012025345B2

(12) United States Patent
Kaupp et al.

(10) Patent No.: US 12,025,345 B2
(45) Date of Patent: Jul. 2, 2024

(54) MODULAR HEATING UNIT

(71) Applicant: Kaupp Leasing, LLC, Billings, MT (US)

(72) Inventors: Cale Patrick Kaupp, Billings, MT (US); Paul James Kaupp, Bassano (CA)

( * ) Notice: Subject to any disclaimer, the term of this patent is extended or adjusted under 35 U.S.C. 154(b) by 591 days.

(21) Appl. No.: 17/217,684

(22) Filed: Mar. 30, 2021

(65) Prior Publication Data

US 2022/0316758 A1 Oct. 6, 2022

(51) Int. Cl.

| | |
|---|---|
| ***F24H 1/10*** | (2022.01) |
| ***E21B 36/02*** | (2006.01) |
| ***E21B 43/26*** | (2006.01) |
| ***F28D 1/053*** | (2006.01) |
| ***F28F 1/04*** | (2006.01) |
| ***F28F 9/02*** | (2006.01) |
| ***F28F 9/24*** | (2006.01) |

(52) U.S. Cl.

CPC ..... *F24H 1/10* (2013.01); *E21B 36/02* (2013.01); *F28D 1/05391* (2013.01); *F28F 1/045* (2013.01); *F28F 9/0246* (2013.01); *F28F 9/24* (2013.01); *E21B 43/26* (2013.01)

(58) Field of Classification Search

CPC ..... F24H 1/10; F24H 1/14; F24H 1/41; F24H 1/045; F24H 1/38; E21B 36/02; E21B 36/025; F28D 1/0246; F28D 1/03; F28D 1/0408; F28D 1/04329; F28D 1/0471; F28D 1/0478; F28D 1/05391; F28D 1/0535; F28D 1/471; F28D 1/476; F28D 1/478; F28D 2021/0024; F28F 9/0221; F28F 9/0246; F28F 9/24; F28F 1/02; F28F 1/045; F28F 3/12; F23B 2700/01

USPC ..... 122/213, 214, 215, 216, 217, 218, 219

See application file for complete search history.

(56) References Cited

U.S. PATENT DOCUMENTS 374,615 A * 12/1887 McKinlay ..... F24H 1/30 122/218

653,246 A * 7/1900 Keith ..... F24H 1/30 122/95.2

(Continued)

OTHER PUBLICATIONS

Canadian Intellectual Property Office; Office Action issued in Canadian Patent Application No. 3149288; dated May 10, 2023 (May 10, 2023).

*Primary Examiner* — Edelmira Bosques
*Assistant Examiner* — Michael James Giordano
(74) *Attorney, Agent, or Firm* — Parsons Behle & Latimer

(57) ABSTRACT

Apparatus, systems, and methods for a modular heating unit that may be adapted to be inline with a pipeline. The unit includes a base member having a main inlet pipe, a header, and pipes connecting the main inlet pipe with the header. A combustion chamber is positioned within the pipes. One or more heat exchangers are connected to the header. The heat exchangers each having a top surface, bottom surface, plurality of fins, inlet ring, inlet port, outlet ring, and outlet port. The modular heating unit includes external inlet and outlet pipes. A first flow path enables fluid to flow from the header into the one or more heat exchangers. An exit flow path connected to the external outlet pipe connects the one or more heat exchangers to an exit port with a portion of the exit flow path being positioned above the one or more heat exchangers.

11 Claims, 15 Drawing Sheets

(56) References Cited

U.S. PATENT DOCUMENTS

| | | | | | |
|---|---|---|---|---|---|
| 1,031,239 | A | * | 7/1912 | Brenner et al. | F24H 1/40<br>122/155.2 |
| 1,209,174 | A | * | 12/1916 | Lang | F24H 1/30<br>122/214 |
| 1,549,483 | A | * | 8/1925 | Gallaher | F24H 1/44<br>122/367.3 |
| 1,576,646 | A | * | 3/1926 | Farmer | F22B 13/00<br>122/214 |
| 1,637,721 | A | * | 8/1927 | Alexander | F24H 1/30<br>122/218 |
| 1,730,385 | A | * | 10/1929 | Schenck | F24H 1/40<br>122/214 |
| 2,726,644 | A | * | 12/1955 | Bettega | F24H 1/38<br>122/215 |

* cited by examiner

MODULAR HEATING UNIT

FIELD OF THE DISCLOSURE

The examples described herein relate to apparatus, systems, and methods for a modular heating unit that may be adapted to heat fluid, such as water, inline for pipelines having varying flow rates.

BACKGROUND

Description of the Related Art

Hydraulic fracturing may be used to improve the production of hydrocarbons from the formation in a wellbore. Hydraulic fracturing is achieved by pumping fluids at very high pressures that are greater than the fracture pressure of the subterranean reservoir, thus cracking the rock creating porosity and improving the production of hydrocarbons. The fluid is often water mixed with proppants and/or other additives.

Before fluid is pumped into the well to fracture the formation, the water is normally heated to the target temperature, which depends of the geologic formation of the subterranean reservoir as well as the chemicals and/or additives being used in the fracturing fluid. One known method to provide heated water for fracturing fluid is to pump the water into a plurality of tanks and the water in each individual tank is then circulated through a heating unit to raise the temperature of the water. This method is rather inefficient as each tank is generally heated to a temperature above the desired target temperature for the fracturing fluid to ensure the water used from the storage tanks is at the desired target temperature when used. The tanks are continually heated increasing the operational costs as well as being rather inefficient.

Another method of heating water to be used in a fracturing procedure is to draw a portion of water from a water source, such as a pipeline, superheat the portion of water, and mix it back into the pipeline. While this method may be more efficient than continually heating holding tanks, only a portion of the water is superheated and then mixed back into a pipeline of unheated water making it difficult to ensure that the mixed water is at the desired target temperature when used in the fracturing procedure. This heating method requires additional components such as pumps and mixers adding to the cost and complexity of this method for heating water. Additionally, this method is not easily adaptable for systems having different flow rates in the pipeline. For example, the amount of water pumped from a pipeline and the temperature that the pumped water is heated to may be optimized for a pipeline having certain flow rate after much trial and error, but the amount and temperature may need to be continually adjusted if the system is to be used with a pipeline having a different flow rate.

Other disadvantages may exist.

SUMMARY

The present disclosure is directed to apparatus, systems, and methods for a modular heating unit that may be adapted to heat fluid, such as water, inline with a pipeline for varying flow rates.

An embodiment of the present disclosure is a modular heating unit. The modular heating unit comprises a base member. The base member includes a main inlet pipe having a main inlet port and a header. The header includes a plurality of output ports. The base member includes a plurality of pipes that fluidly connect the main inlet pipe with the header. The base member includes a combustion chamber within the plurality of pipes and the header and an external opening through the pipes that provides access to the combustion chamber.

The modular heating unit comprises a first heat exchanger connected to the header. The first heat exchanger has a top surface, a bottom surface, a plurality of fins positioned between the top surface and the bottom surface, a first inlet ring, a first inlet port located along the first inlet ring, a first outlet ring, and a first outlet port located along the first outlet ring. The modular heating unit includes an external inlet pipe and an external outlet pipe. The external inlet pipe comprising a first end and a second end, the first end being closed, and the second end being closed, wherein the external inlet pipe comprises the first inlet ring. The external outlet pipe comprises a first end and a second end, the first end being closed and the second end being open, wherein the external inlet pipe comprises the first outlet ring.

The modular heating unit includes a first flow path and an exit port. The first flow path enables fluid to flow from the header into the first heat exchanger via the first inlet port along the first inlet ring. The modular heating unit includes an exit flow path connected to the second end of the external outlet pipe. The exit flow path fluidly connects the first outlet port along the first outlet ring to the exit port, wherein a portion of the exit flow path is positioned above the top surface the first heat exchanger.

Each of the plurality of fins of the first heat exchanger may be substantially vertical to form an angle of substantially ninety degrees with respect to the bottom surface of the first heat exchanger. Each of the plurality of fins of the first heat exchanger may not be substantially vertical with respect to the bottom surface of the first heat exchanger. Each of the plurality of fins of the first heat exchanger may form an angle of approximately thirty-three degrees with respect to the bottom surface of the first heat exchanger.

The modular heating unit may include a second heat exchanger connected to the first heat exchanger. The second heat exchanger comprises a top surface, a bottom surface, a plurality of fins positioned between the top surface and the bottom surface, a second inlet ring, a second inlet port along the second inlet ring, a second outlet ring, and a second outlet port along the second outlet ring. The external inlet pipe may comprise the second inlet ring, wherein fluid may enter into the second heat exchanger via the first flow path, the first inlet ring, the second inlet ring, and the second inlet port. The external outlet pipe may comprise the second outlet ring, wherein fluid may flow from the second heat exchanger to the exit port via the second outlet port, the second outlet ring, and the exit flow path. A portion of the exit flow path may be positioned above the top surface of the second heat exchanger.

The first heat exchanger of the modular heating unit may have a first perimeter having a first shape and the second heat exchanger of the modular heating unit may have a second perimeter having a second shape that differs from the first shape. The modular heating unit may include a lower inlet coupling that fluidly connects the first flow path to the first inlet ring. The modular heating unit may include a first inlet coupling that fluidly connects the first inlet ring to the second inlet ring. The modular heating unit may include a first outlet coupling that fluidly connects the first outlet ring to the second outlet ring. The modular heating unit may include an upper outlet coupling that fluidly connects the second end of the external outlet pipe to the exit flow path wherein fluid may flow from the header and into the first heat exchanger via the first flow path, the lower inlet coupling, the first inlet ring, and the first inlet port. Fluid may flow from the header and into the second heat exchanger via the first flow path, the lower inlet coupling, the first inlet ring, the first inlet coupling, the second inlet ring, and the second inlet port. Fluid may flow from the first heat exchanger to the exit port via the first outlet port, the first outlet ring, the first outlet coupling, the second outlet ring, the upper outlet coupling, and the exit flow path. Fluid may flow from the second heat exchanger to the exit port via the second outlet port, the second outlet ring, the upper outlet coupling, and the exit flow path.

The lower inlet coupling, the first inlet ring, the first inlet coupling, and the second inlet ring may form the external inlet pipe. The first outlet ring, the first outlet coupling, the second outlet ring, and the upper outlet coupling may form the external outlet pipe. The modular heating unit may include a first heating element connected to the first end of the external inlet pipe and a second heating element connected to the first end of the external outlet pipe. The modular heating unit may include a domed end cap and a lower outlet coupling that connects the domed end cap to the first outlet ring, wherein the second heating element is connected to the domed end cap.

The modular heating unit may include a third heat exchanger connected to the second heat exchanger. The third heat exchanger comprises a top surface, a bottom surface, and a plurality of fins positioned between the top surface and the bottom surface, a third inlet ring, a third inlet port along the third inlet ring, a third outlet ring, and a third outlet port along the third outlet ring. The external inlet pipe may comprise the third inlet ring, wherein fluid may enter into the third heat exchanger via the first flow path, the first inlet ring, the second inlet ring, the third inlet ring, and the third inlet port. The external outlet pipe may comprise the third outlet ring, wherein fluid may flow from the third heat exchanger to the exit port via the third outlet port, the third outlet ring, and the exit flow path. A portion of the exit flow path may be positioned above the top surface of the third heat exchanger.

The modular heating unit may include a second inlet coupling that connects the third inlet ring to the second inlet ring and a second outlet coupling that connects the third outlet ring to the second outlet ring. Fluid may flow from the header and into the third heat exchanger via the first flow path, the lower inlet coupling, the first inlet ring, the first inlet coupling, the second inlet ring, the second inlet coupling, the third inlet ring, and the third inlet port. Fluid may flow from the first heat exchanger to the exit port via the first outlet port, the first outlet ring, the first outlet coupling, the second outlet ring, the second outlet coupling, the third outlet ring, the upper outlet coupling, and the exit flow path. Fluid may flow from the second heat exchanger to the exit port via the second outlet port, the second outlet ring, the second outlet coupling, the third outlet ring, the upper outlet coupling, and the exit flow path. Fluid may flow from the third heat exchanger to the exit port via the third outlet port, the third outlet ring, the upper outlet coupling, and the exit flow path.

An embodiment of the present disclosure is a modular heating system. The modular heating system include a base member. The base member comprises a main inlet pipe having a main inlet port and a header, the header including a plurality of output ports. A plurality of pipes fluidly connect the main inlet pipe with the header. The base member includes a combustion chamber within the plurality of pipes and the header and an external opening through the pipes that provides access to the combustion chamber. The system includes a burner positioned within the combustion chamber, wherein the burner is configured to heat fluid within the pipes. The system includes a first flow path and a plurality of modular heat exchangers in fluid communication. The plurality of modular heat exchangers comprises a lower modular heat exchanger, an upper modular heat exchanger, and one or more modular heat exchangers positioned between the lower modular heat exchanger and the upper modular heat exchanger with the lower modular heat exchanger being connected to the header. The first flow path fluidly couples the header to the lower modular heat exchanger.

The system includes an exit port and an exit flow path from the upper modular heat exchanger, the exit flow path connects the upper modular heat exchanger to the exit port. The system comprises an inlet pipeline connected to the main inlet port, the inlet pipeline having a flow of fluid and an outlet pipeline connected to the exit port. A portion of the exit flow path is positioned above a top surface of the upper modular heat exchanger. Fluid may enter the main inlet pipe via the main inlet port, flow through the plurality of pipes, flow through the header, and flow through at the plurality of modular heat exchangers, the exit flow path, and flow out the exit port as heated fluid. Wherein the entire flow of fluid of the inlet pipeline flows through the main inlet port and the exit port to the outlet pipeline.

The exit flow path of the modular heating system may include a one-hundred-and-eighty-degree bend between the upper modular heat exchanger and the exit port. At least one of the plurality of modular heat exchangers may have a perimeter having a first shape and at least one of the plurality of modular heat exchangers may have a perimeter having a second shape that differs from the first shape. Each of the plurality of heat exchangers may include an inlet ring, an inlet port along the inlet ring, an outlet ring, and an outlet port along the outlet ring, wherein the inlet rings are connected together by a plurality of couplings to form an external inlet pipe and wherein the outlet rings are connected together via a plurality of couplings to form an external outlet pipe. The first flow path may be fluidly coupled to the inlet ring of the lower modular heat exchanger. The external inlet pipe may be closed at a first end and may be closed at a second end and the external outlet pipe may be closed at a first end and the exit flow path may be fluidly connected to the second end of the external outlet pipe via a coupling.

One embodiment of the present disclosure is a method comprising receiving a fluid into a base via a main inlet port of a main inlet pipe and flowing the fluid through a plurality of pipes connected to the main inlet pipe. The method includes heating the fluid with a heating device located within a combustion chamber positioned in a cavity between the plurality of pipes and flowing the fluid through a header. The method comprises flowing the fluid into one or more modular heat exchangers fluidly connected to the header. The method includes flowing the fluid out of the one or more heat exchangers into an exit flow path, wherein a portion of the exit flow path rises above an upper most surface of the one or more modular heat exchangers. The method comprises flowing fluid out an exit port of the exit flow path.

Flowing the fluid into one or more modular heat exchangers may comprise flowing the fluid into an external inlet pipe formed of an inlet ring of each of the one or more of modular heat exchangers being fluidly coupled together. Flowing the fluid out of the one or more heat exchangers into an exit flow path may comprise flowing the fluid into an external outlet pipe formed of an outlet ring of each of the one or more modular heat exchangers being fluidly coupled together with the exit flow path being fluidly coupled to the external outlet pipe. Receiving the fluid into the base via the main inlet port may comprise receiving an entire flow of an inlet pipeline and wherein flowing fluid out an exit port of the exit flow path further comprising flowing the entire flow into an outlet pipeline.

Figure 1:
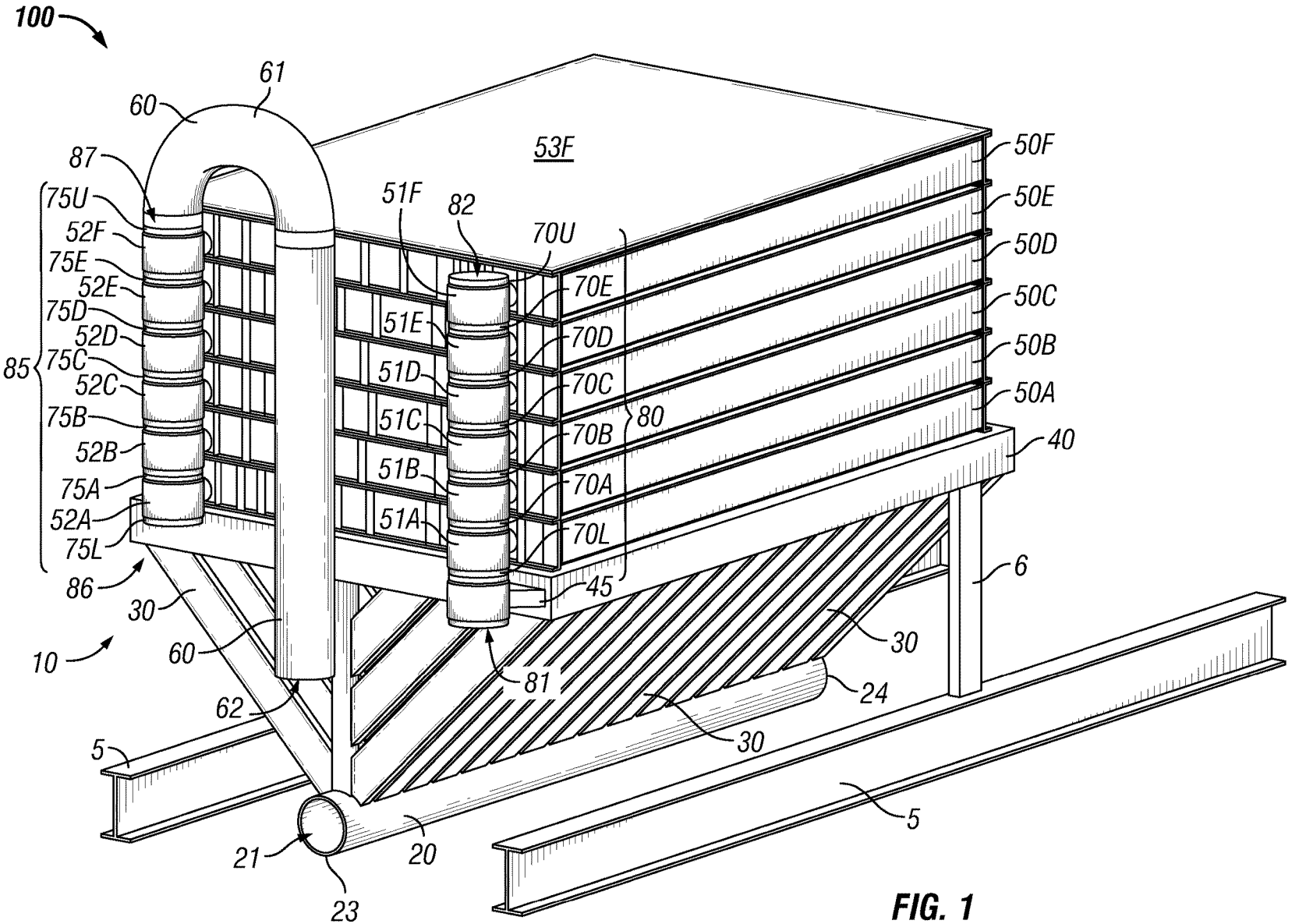
FIG. 1 is a perspective view of an embodiment of a modular heating unit.

While the disclosure is susceptible to various modifications and alternative forms, specific examples have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

In this disclosure, numerous specific details are discussed to provide a thorough and enabling description for embodiments of the present disclosure. One of ordinary skill in the art will recognize that the disclosure can be practiced without one or more of the specific details. Well-known structures and/or operations often associated with modular heating devices and heat exchangers may not be shown and/or may not be described in detail to avoid obscuring other aspects of the disclosure. In general, it should be understood that various other devices, systems, and/or methods in addition to those specific embodiments disclosed herein may be within the scope of the present disclosure.

As used herein, the terms "vertical," "lateral," "upper," and "lower" can refer to relative directions or positions of features in the modular heating units and/or modular heating systems shown in the Figures. For example, "upper" or "uppermost" can refer to a feature positioned closer to the top of a page than another feature. These terms, however, should be construed broadly to include modular heating units and/or modular heating systems having other orientations, such as inverted or inclined orientations where top/bottom, over/under, above/below, up/down, and left/right can be interchanged depending on the orientation.

Figure 2:
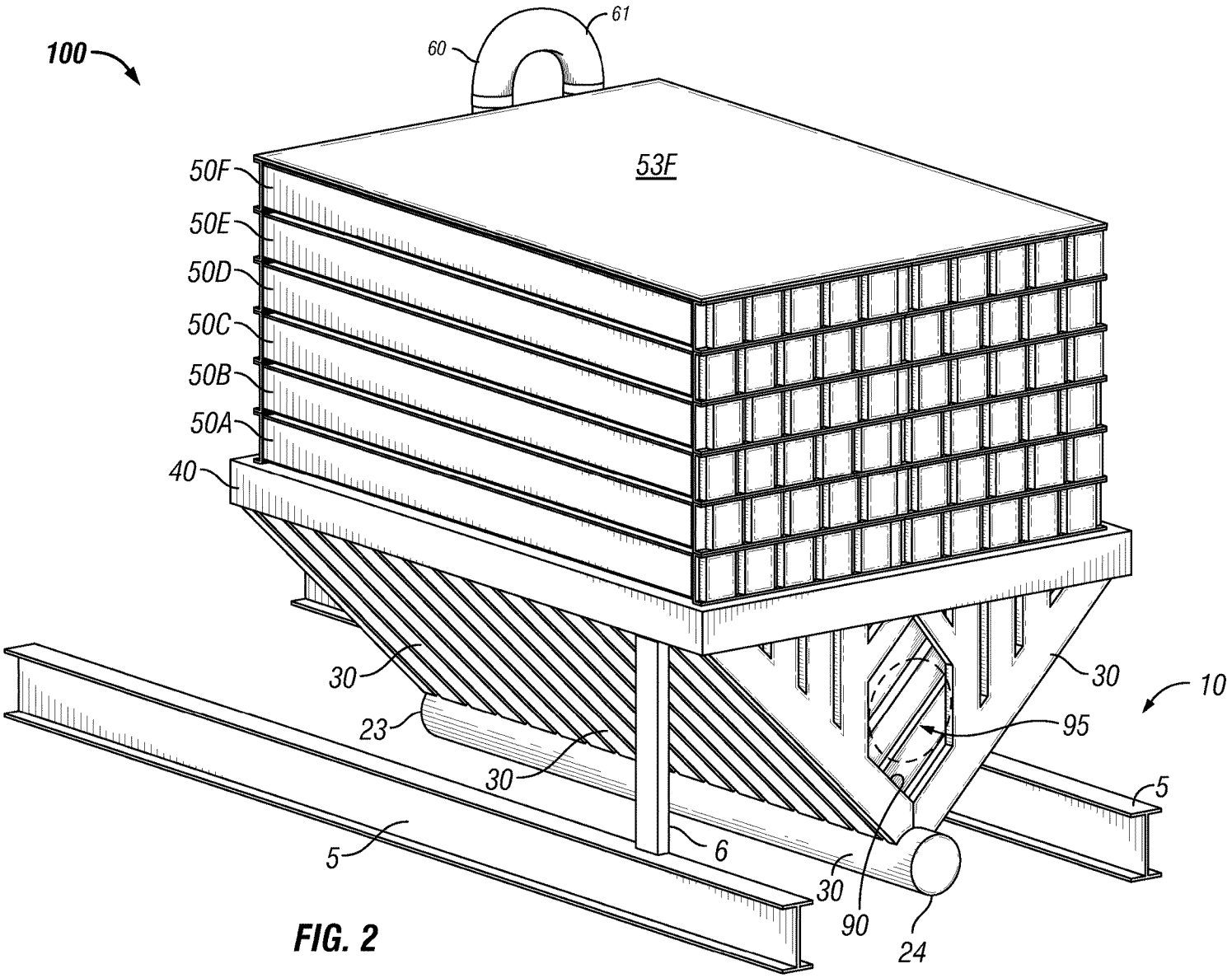
FIG. 2 is a perspective view of an embodiment of a modular heating unit.

FIG. 1 is a first perspective view and FIG. 2 is a second perspective view of an embodiment of a modular heating unit 100. The modular heating unit 100 includes a base member 10. The base member 10 includes a main inlet pipe 20 connected to a header 40 via a plurality of pipes 30. The main inlet pipe 20 having a first end 23 and a second end 24 opposite of the first end 23. The main inlet pipe 20 includes a main inlet port 21 located at a first end 23. An inlet pipeline may be connected to the main inlet pipe 20 at the main inlet port 21 to enable fluid to flow through the modular heating unit 100 as discussed herein. The second end 24 of the main inlet pipe 20 is closed. The main inlet pipe 20 includes a plurality of apertures 22 (shown in FIG. 7) that are in fluid communication with the bore of the main inlet pipe 20.

A plurality of pipes 30 connect the bore of the main inlet pipe 20 to the header 40 via a plurality of output ports 41 (shown in FIG. 10) in the header 40. Fluid, such as water, may enter the modular heating unit 100 via the main inlet port 21 of the base member 10 and travel to the header 40 via the pipes 30 to then be distributed to the heat exchangers 50A-50F connected to the header 40 as discussed herein. The base member 10 includes a combustion chamber 95 within the plurality of pipes 30 and the header 40 and an external opening 90 through the pipes 30 that provides access to the combustion chamber 95.

Figure 5:
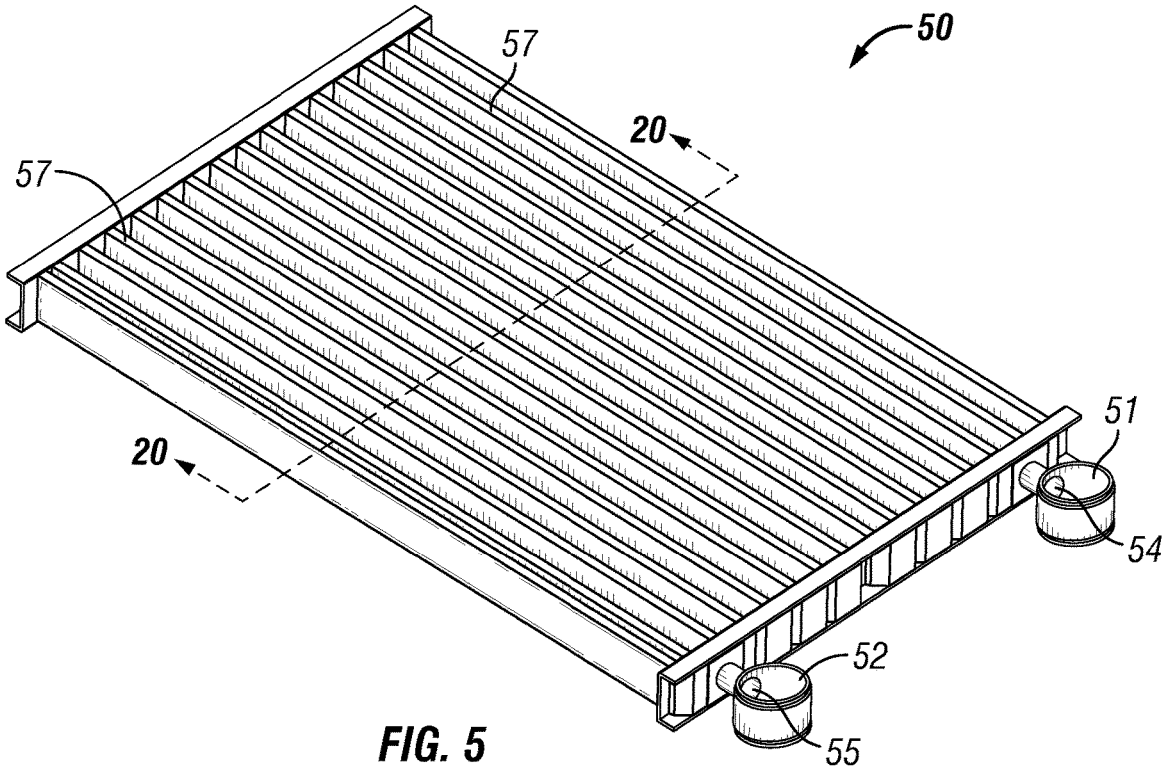
FIG. 5 is a perspective view of an embodiment of a modular heat exchanger.

The modular heating unit 100 comprises a first heat exchanger 50A connected to the header 40. The first heat exchanger 50A has a top surface, a bottom surface, a plurality of fins positioned between the top surface and the bottom surface, a first inlet ring 51A, a first inlet port located along the first inlet ring 51A, a first outlet ring 52A, and a first outlet port located along the first outlet ring 52A. The top and bottom surfaces of the first heat exchanger 50A may not be viewed in FIGS. 1 and 2 as the bottom surface of the first heat exchanger 50A is connected to the header 40 and a plurality of heat exchangers 50B-50E are connected above the first heat exchanger 50A. Likewise, the plurality of fins may not be viewed in FIGS. 1 and 2 as they are internal to the first heat exchanger 50A. The first heat exchanger 50A may be any of the embodiments disclosed herein, such as but not limited to the heat exchangers shown in FIGS. 5 and 18, or equivalent heat exchangers as would be appreciated by one of ordinary skill in the art having the benefit of this disclosure. Similarly, the first inlet port and first outlet port may not be viewed in FIGS. 1 and 2 but may be similar to the inlet port 54 and outlet port 55 of the heat exchanger 50 are shown in FIG. 5.

The modular heating unit 100 includes an external inlet pipe 80 and an external outlet pipe 85. The external inlet pipe 80 comprising a first end 81 and a second end 82, the first end 81 being closed, and the second end 82 being closed, wherein the external inlet pipe 80 comprises the first inlet ring 51A. The external outlet pipe 85 comprising a first end 86 and a second end 87, the first end 86 being closed and the second end 87 being open, wherein the external inlet pipe 85 comprises the first outlet ring 52A. The modular heating unit 100 is connected to rails 5 by one or more supports 6. The rails 5 enable the modular heating unit 100 to be stably positioned on a flat surface as well as enable the modular heating unit 100 to be moved by equipment as would be appreciated by one of ordinary skill in the art having the benefit of this disclosure.

The modular heating unit 100 includes a second heat exchanger 50B connected to the first heat exchanger 50A. The second heat exchanger 50B comprises a top surface, a bottom surface, a plurality of fins positioned between the top surface and the bottom surface, a second inlet ring 51B, a second inlet port along the second inlet ring 51B, a second outlet ring 52B, and a second outlet port along the second outlet ring 52B. The top and bottom surfaces of the second heat exchanger 50B may not be viewed in FIGS. 1 and 2. Likewise, the plurality of fins may not be viewed in FIGS. 1 and 2 as they are internal to the second heat exchanger 50B. The second heat exchanger 50B may be any of the embodiments disclosed herein, such as but not limited to the heat exchangers shown in FIGS. 5 and 18, or equivalent heat exchangers as would be appreciated by one of ordinary skill in the art having the benefit of this disclosure. Similarly, the second inlet port and second outlet port may not be viewed in FIGS. 1 and 2 but may be similar to the inlet port 54 and outlet port 55 of the heat exchanger 50 are shown in FIG. 5.

The modular heating unit 100 includes a third heat exchanger 50C connected to the second heat exchanger 50B, a fourth heat exchanger 50D connected to the third heat exchanger 50C, a fifth heat exchanger 50E connected to the fourth heat exchanger 50D, and a sixth heat exchanger 50F heat exchanger connected to the fifth heat exchanger 50E. Each of the heat exchangers 50A-50F comprises a top surface, a bottom surface, a plurality of fins positioned between the top surface and the bottom surface, an inlet ring 51A-51F, an inlet port along the inlet ring 51A-51F, an outlet ring 52A-52F, and an outlet port along the outlet ring 52A-52F. FIG. 1 shows the top surface 53F of the sixth heat exchanger 50F. The top and bottom surfaces of the rest of heat exchangers 50A-50E as well as the bottom surface of the sixth heat exchanger 50F may not be viewed in FIGS. 1 and 2. Likewise, the plurality of fins may not be viewed in FIGS. 1 and 2 as they are internal to the heat exchangers. The heat exchangers 50A-50F may be any of the embodiments disclosed herein, such as but not limited to the heat exchangers shown in FIGS. 5 and 18, or equivalent heat exchangers as would be appreciated by one of ordinary skill in the art having the benefit of this disclosure. Similarly, the inlet ports and the outlet ports may not be viewed in FIGS. 1 and 2 but may be similar to the inlet port 54 and outlet port 55 of the heat exchanger 50 shown in FIG. 5. The six heat exchangers 50A-50*f* in FIG. 1 are shown for illustrative purposes. For example, the number, size, and/or configuration may be varied as would be appreciated by one of ordinary skill in the art having the benefit of this disclosure. The modular heating unit 100 may have one or more heat exchangers referred to individually as a heat exchanger 50.

The modular heating unit 100 includes a plurality of couplings 70A-70E and 75A-75E that fluidly couple the heat exchangers 50A-50F to form the external inlet pipe 80 and external outlet pipe 85. The modular heating unit 100 also includes a lower inlet coupling 70L that fluidly connects the first flow path 45 to the first inlet ring 51A. The modular heating unit 100 includes an upper outlet coupling 75U that fluidly couples the exit flow path 60 to the external outlet pipe 85 and a lower outlet coupling 75L that may cap of the first end 86 of the external outlet pipe 85. As discussed herein, a lower inlet coupling 70L fluidly couples the first end 81 of the external inlet pipe 80 to the first flow path 45.

Fluid from a pipeline may enter the modular heating unit 100 via main inlet port 21 of the main inlet pipe 20. A heating element 160 (shown in FIG. 11), which may be but is not limited to a burner or the like, may be positioned within the combustion chamber 95 positioned within a cavity or recess between the pipes 30 and the header 40. The fluid, which may be water, is heated by the heating element 160 as it flows from the main inlet pipe 20 to the header 40 via the pipes 30. The fluid is continued to be heated as it enters the external inlet pipe 80 via the first flow path 45 and flows into the inlet port of one of the heat exchangers 50A-50F. The heated fluid then exits the respective heat exchanger 50A-50F to enter to the external outlet pipe 85. The heated fluid then flows up the external outlet pipe 85 to the exit flow path 60 to the exit port 62 to an exit pipeline connected thereto. A portion 61 of the exit flow path 60 rises above the top surface of the uppermost heat exchanger to ensure that the external inlet pipe 80 and external outlet pipe 85 are substantially filled with heated fluid. The modularity of the heating unit 100 enables the modular heating unit 100 to be used with pipelines having varying flow rates. For example, a heating unit 100 having five heat exchangers 50A-50E connected to the base member 10 may be able to handle approximately 50 barrels of fluid per minute. The addition of one or more heat exchangers to the modular heating unit 100 will increase the flow capacity. Likewise, the removal of heat exchangers 50 lowers the capacity of flow through the heating unit 100.

Figure 3:
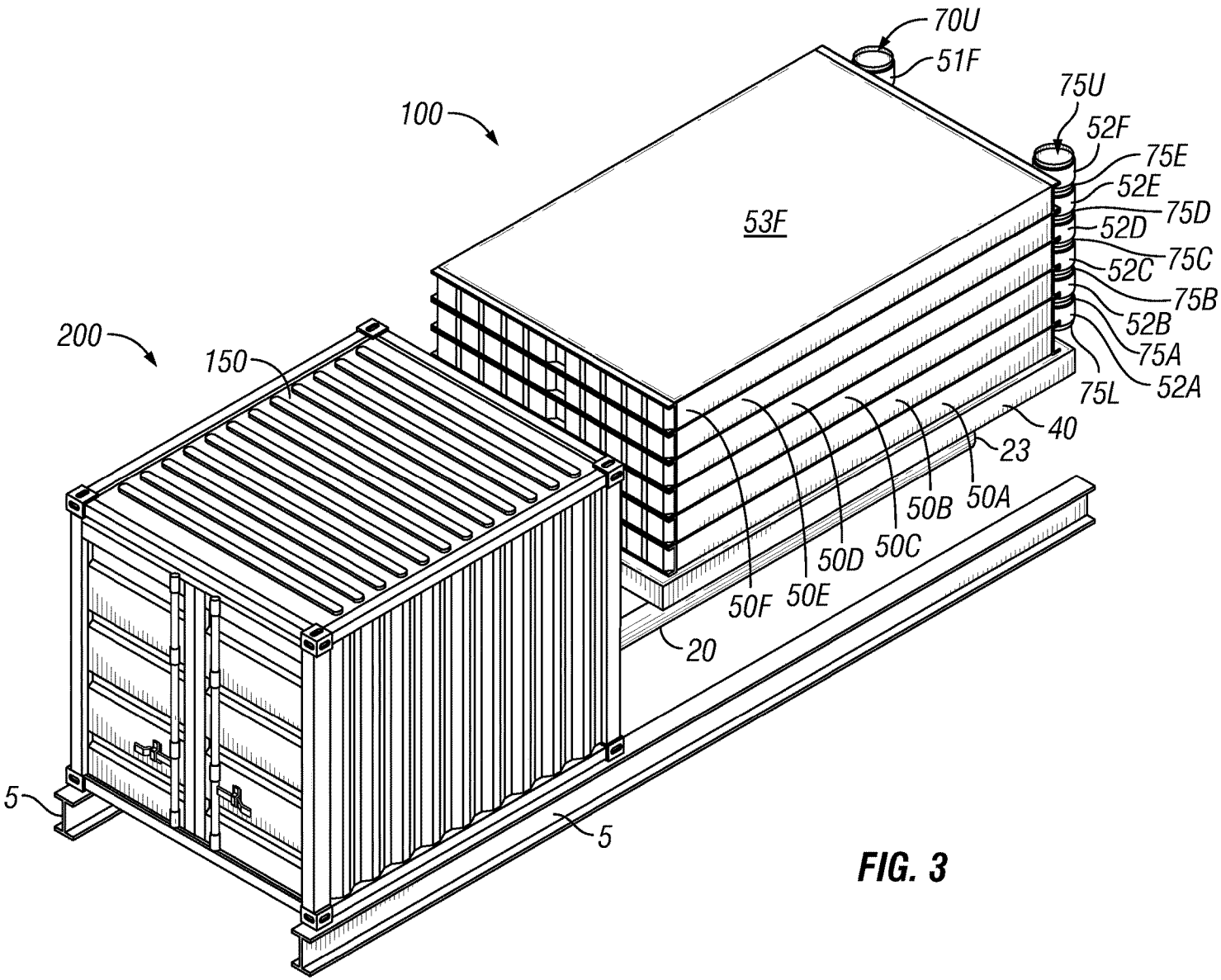
FIG. 3 is a perspective view of an embodiment of a modular heating system.

FIG. 3 is perspective view of an embodiment of a modular heating system 200. The modular heating system 200 includes an operations control container 150 positioned adjacent to a modular heating unit 100. The exit flow path 60 and a portion of the plurality of pipes 30 are not shown in FIG. 3 for clarity. The modular heating system 200 includes rails 5, which may enable the modular heating system 200 to be moved by equipment. The operations control container 150 includes controls to operate a heating element 160 positioned within the modular heating unit 100 to heat fluid being flown through the modular heating unit 100. The operations control container 150 includes equipment to monitor and control the temperature to which the fluid is heated by the modular heating unit 100.

Figure 4:
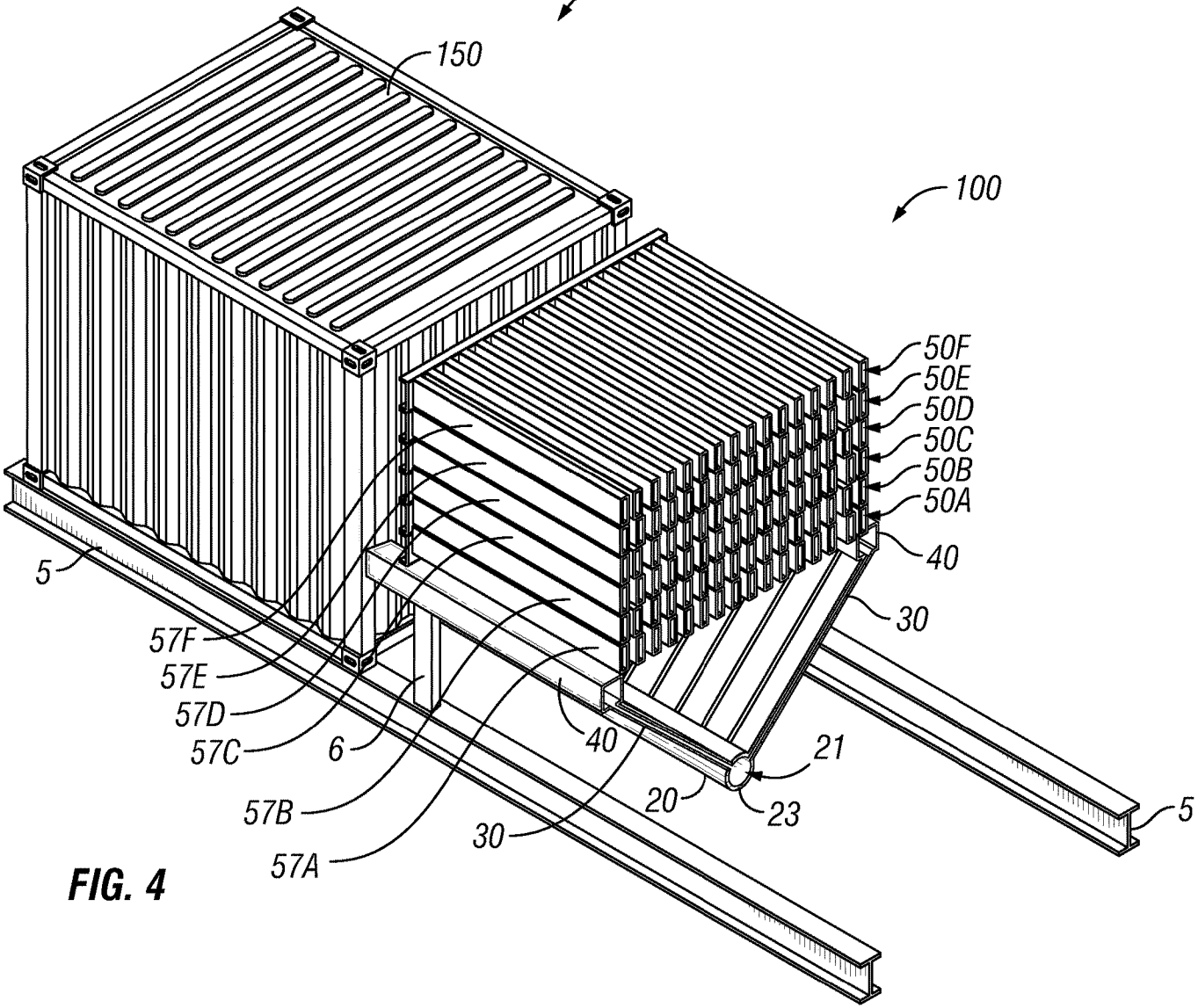
FIG. 4 is a partial cut-away view of an embodiment of a modular heating system.

FIG. 4 is a partial cut-away view of an embodiment of a modular heating system 200 with portions of the modular heat exchangers 50A-50F removed for clarity. The modular heat exchangers 50A-50F includes internal fins 57A-57F that are substantially vertically aligned with the tops and bottoms of each respective modular heat exchanger 50A-50F. As discussed herein, fluid enters the modular heating unit 100 via main inlet pipe 20. The fluid is heated as it flows from the main inlet pipe 20 and through the modular heat exchangers 50A-50F via pipes 30 and the header 40 as discussed herein.

FIG. 5 is a perspective view of an embodiment of a modular heat exchanger 50. The top surface of the modular heat exchanger 50 is not shown for clarity. The modular heat exchanger 50 includes a plurality of fins 57 located internally. That is, the plurality of fins 57 are positioned between the top surface and the bottom surface of the modular heat exchanger 50. The modular heat exchanger 50 includes an inlet ring 51 and an outlet ring 52. The inlet and outlet rings 51, 52 may be connected to other modular heat exchangers via a fluidic coupling. Various fluidic couplings may be used to connect modular heat exchangers together as part of a modular heating unit 100 as would be appreciated by one of ordinary skill in the art having the benefit of this disclosure. For example, the fluidic coupling may be, but is not limited to, a VICTAULIC pipe coupling offered commercially by Victaulic of Easton, Pennsylvania. The modular heat exchanger 50 includes an inlet port 54 positioned along inlet ring 51 that lets fluid enter the modular heat exchanger 50 and flow along the fins and out an outlet port 55 positioned along the outlet ring 52.

Figure 6:
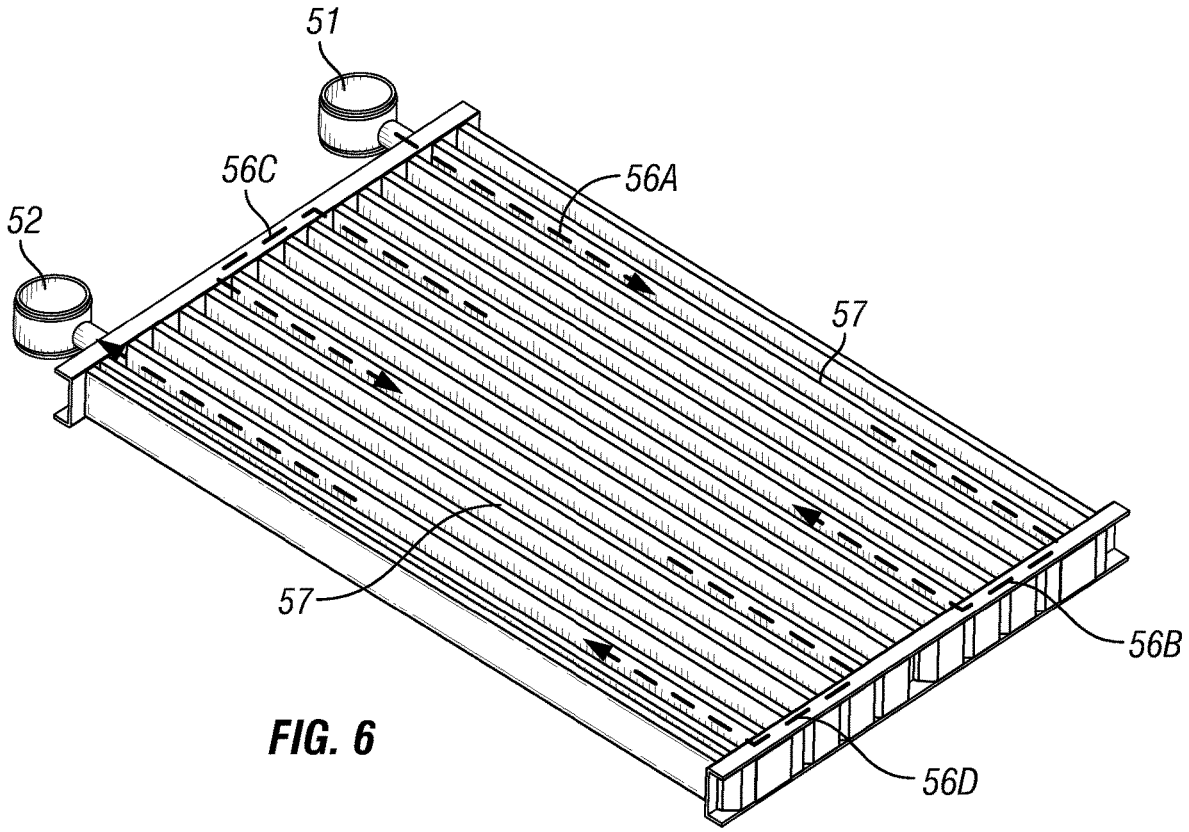
FIG. 6 is a schematic of an embodiment of a modular heat exchanger.

FIG. 6 is a schematic of an embodiment of a modular heat exchanger 50 showing one configuration of the flow of fluid through the modular heat exchanger 50. Fluid flows into the modular heat exchanger 50 via the inlet port 54 along the inlet ring 51 as shown by arrow 56A. Fluid flows along the fins 57 in different directions through portions of the modular heat exchanger 50 as shown by arrows 56B and 56C. Finally, fluid flows out of the modular heat exchanger 50 via outlet port 55 along the outlet ring 52 as shown by arrow 56D.

Figure 7:
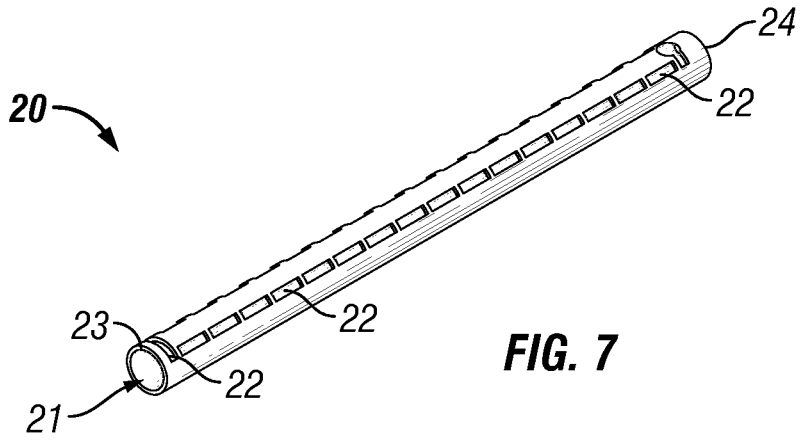
FIG. 7 is a perspective view of an embodiment of a main inlet pipe.

FIG. 7 is a perspective view of an embodiment of a main inlet pipe 20. The main inlet pipe 20 includes a main inlet port 21 at a first end 23 and is closed at a second end 24. The main inlet pipe 20 includes a plurality of apertures 22 through the wall of the main inlet pipe 20 that enable communication with the bore of the main inlet pipe. The plurality of apertures 22 are configured to enable the insertion of a plurality of pipes 30 that may be used to fluidly connect the main inlet pipe 20 to a header 40 as discussed herein.

Figure 8:
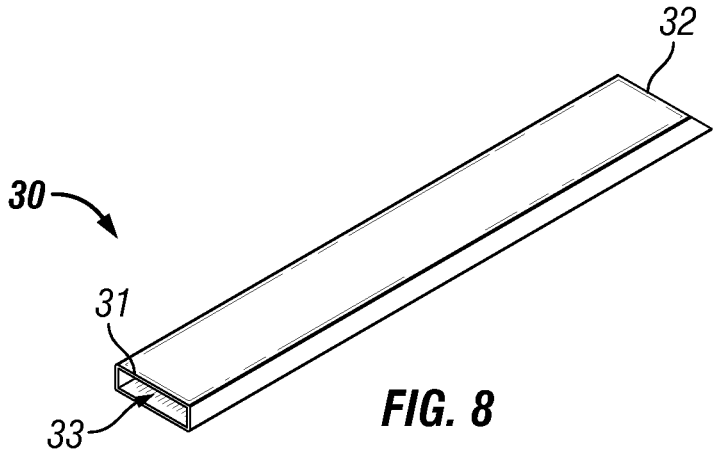
FIG. 8 is a perspective view of an embodiment of a pipe that may connect a main inlet pipe to a header.

FIG. 8 is a perspective view of an embodiment of a pipe 30 that may connect a main inlet pipe 20 to a header 40. The pipe 30 has a first end 31 and a second end 32 and a bore 33 that extends from the first end 31 to the second end 32. The bore 33 may have a rectangular cross-section as shown in FIG. 8. The shape, size, and/or configuration of the pipe 30 and bore 33 is shown for illustrative purposes and may be varied as would be appreciated by one of ordinary skill in the art having the benefit of this disclosure. For example, the bore 33 of the pipe 30 may be non-rectangular in shape.

Figure 9:
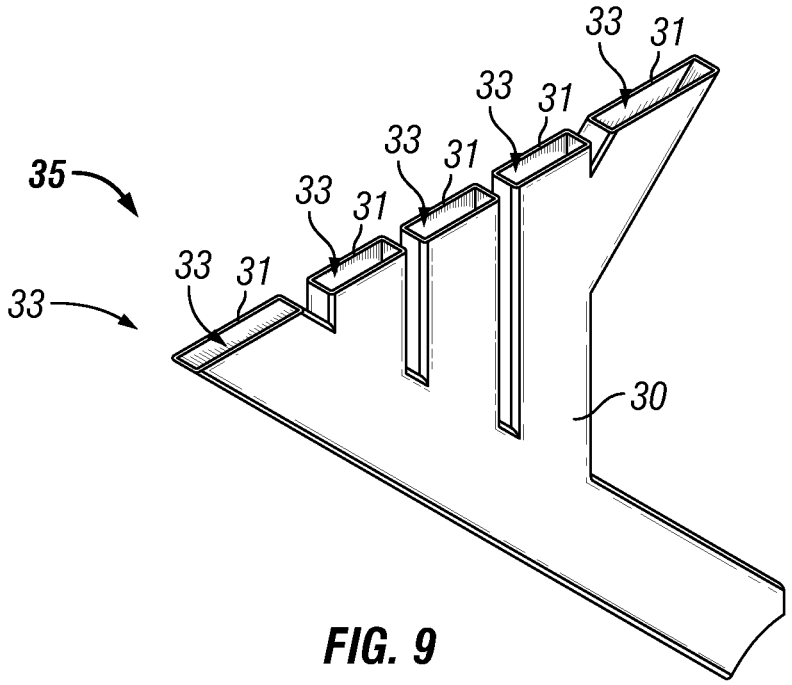
FIG. 9 is a perspective view of an embodiment of a plurality of pipes that may connect a main inlet pipe to a header.

FIG. 9 is a perspective view of a portion of an embodiment of an assembly 35 of plurality of pipes 30 that may connect a main inlet pipe 20 to a header 40. Various configurations may be used to connect pipes 30 to a header 40 to enable fluid to flow from the main inlet pipe 20 to the header 40 as would be appreciated by one of ordinary skill in the art having the benefit of this disclosure.

Figure 10:
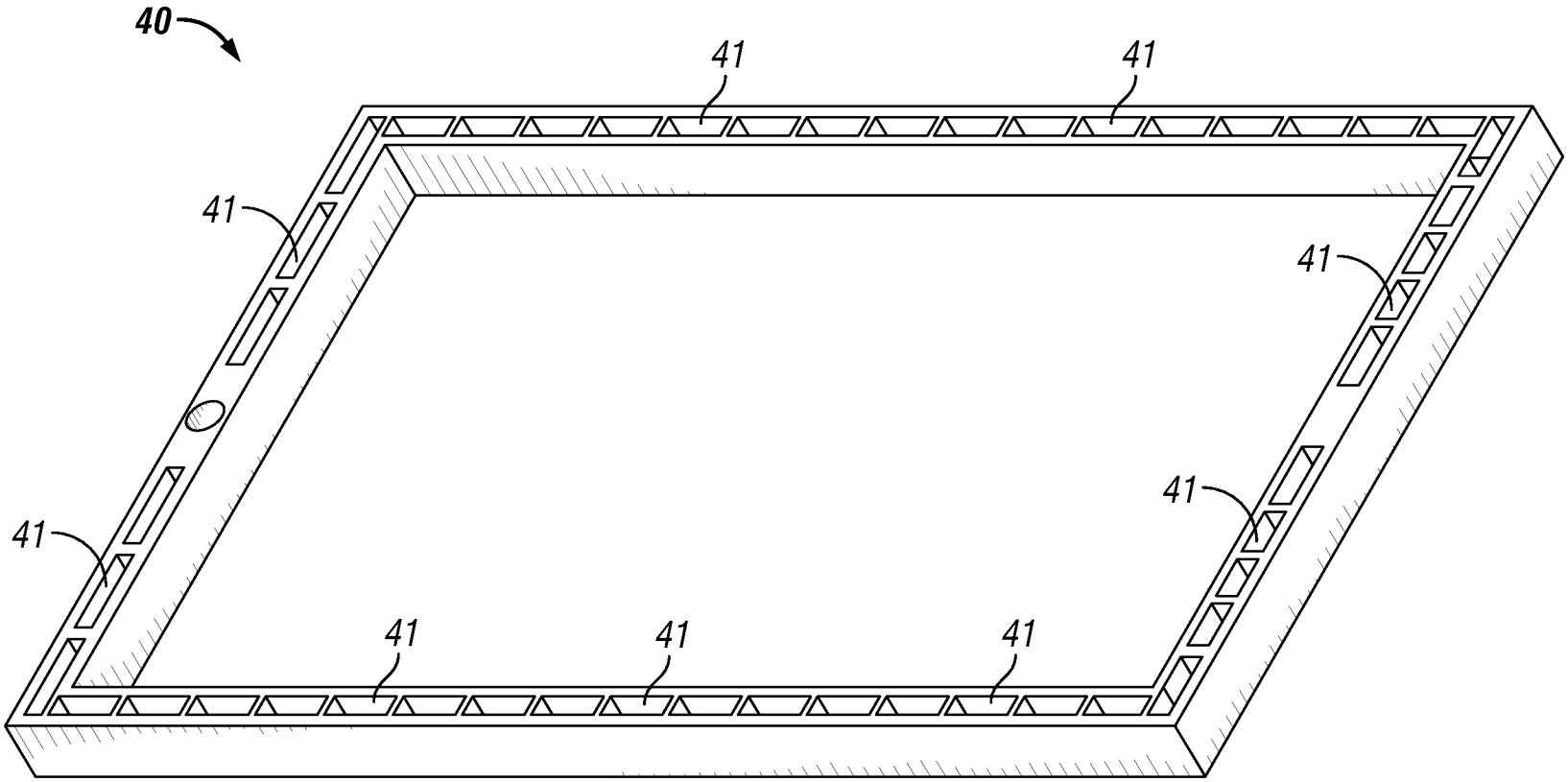
FIG. 10 is a perspective view of an embodiment of a header.

FIG. 10 is a perspective view of an embodiment of a header 40. The header includes a plurality of output ports 41 that are configured to receive a plurality of pipes 30 to enable fluid to flow from the main inlet pipe 20 to the header 40 as discussed herein. The header 40 includes a central bore or path that enables the header 40 fill up with fluid from the plurality of pipes 30. The header 40 is configured to connected to a modular heat exchanger 30 as discussed herein. A first flow path 45 (shown in FIG. 1) enables the fluid to flow from the header to one or more modular heat exchangers 50 connected to the header 40 as discussed herein.

Figure 11:
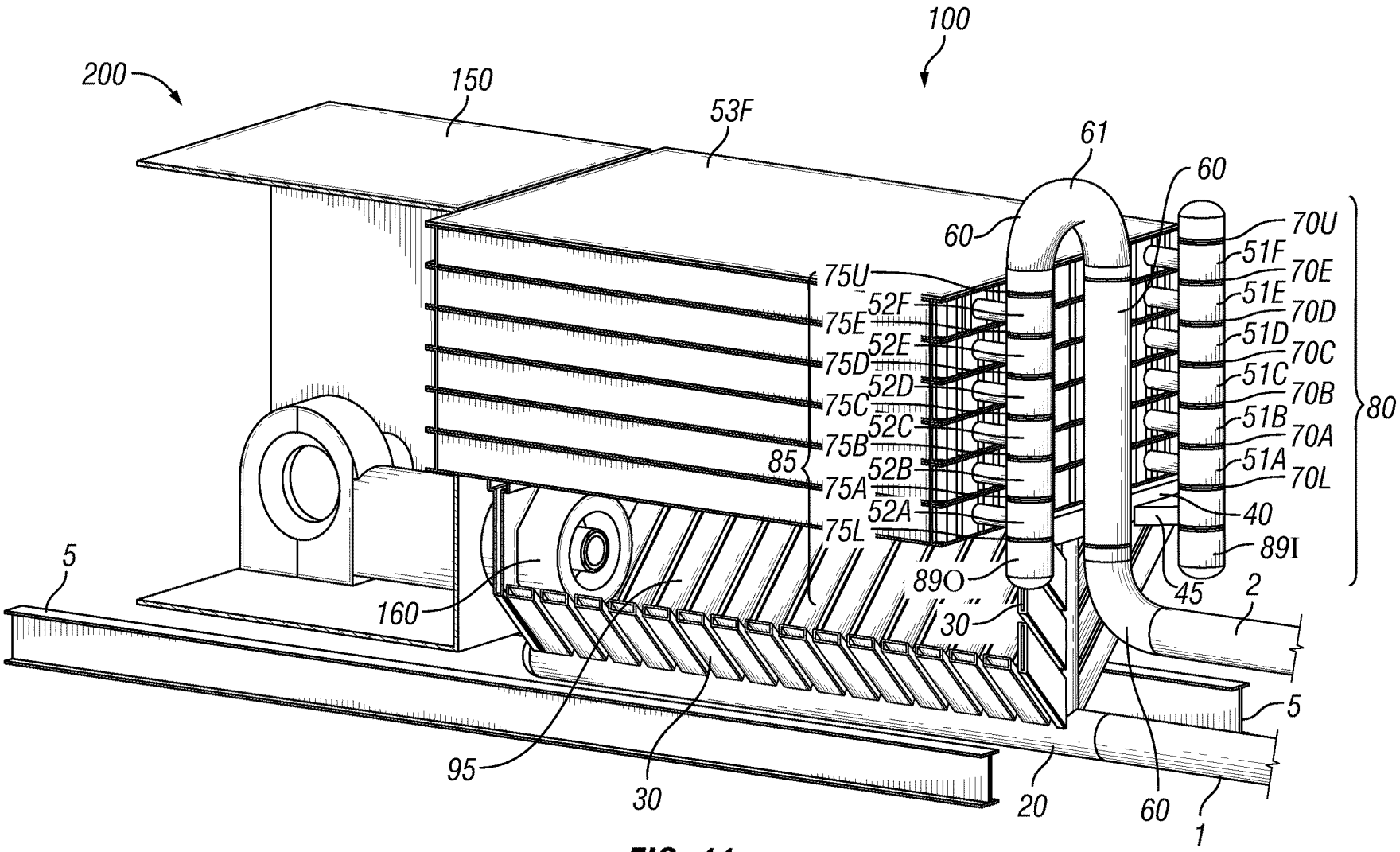
FIG. 11 is a partial cutaway view of an embodiment of a modular heating system.

FIG. 11 is a partial cutaway view of an embodiment of a modular heating system 200. The modular heating system 200 include a base member 10. The base member comprises a main inlet pipe 20 having a main inlet port 21 and a header 40, the header including a plurality of output ports 41. A plurality of pipes 30 fluidly connect the main inlet pipe 20 with the header 40. The base member 10 includes a combustion chamber 95 within the plurality of pipes 30 and the header 10 and an external opening 90 (shown in FIG. 2) through the pipes 30 that provides access to the combustion chamber 95. The modular heating system 200 includes a heating element 160, which may be a burner, positioned within the combustion chamber 95, wherein the heating element 160 is configured to heat fluid within the pipes 30. The modular heating system 200 includes a first flow path 45 and a plurality of modular heat exchangers 50A-50F in fluid communication. The plurality of modular heat exchangers 50A-50F comprises a lower modular heat exchanger 50A, an upper modular heat exchanger 50F, and one or more modular heat exchangers 50B-50E positioned between the lower modular heat exchanger 50A and the upper modular heat exchanger 50F with the lower modular heat exchanger 50A being connected to the header 40. The first flow path 45 fluidly couples the header 40 to the lower modular heat exchanger 50A.

FIG. 11 shows the modular heating system 200 having six modular heat exchangers 50A-50F for illustrative purpose. The number, size, shape, and/or configuration of the modular heat exchangers 50A-50F may be varied and/or modified as would be appreciated by one or ordinary skill in the art having the benefit of this disclosure. For example, the modular heating system 200 may have more or less than six modular heat exchangers 50. The modular heating system 200 includes an operations control container 150 that controls the operation of the heating element 160 to heat up fluid moving through the modular heating system 200.

The modular heating system 200 includes an exit port 21 and an exit flow path 60 from the upper modular heat exchanger 50F, the exit flow path 60 connects the upper modular heat exchanger 50F to the exit port 21. The modular heating system 200 comprises an inlet pipeline 1 connected to the main inlet port 21, the inlet pipeline 1 having a flow of fluid and an outlet pipeline 2 connected to the exit port 62. A portion 61 of the exit flow path 60 is positioned above a top surface of the upper modular heat exchanger 50F. Fluid may enter the main inlet pipe 20 via the main inlet port 21, flow through the plurality of pipes 30, flow through the header 40, and flow through the plurality of modular heat exchangers 50A-50F, the exit flow path 60, and flow out the exit port 21 into the outlet pipeline 2 as heated fluid. Wherein the entire flow of fluid of the inlet pipeline flows 1 through the main inlet port 21 and the exit port 62 to the outlet pipeline 2. The flow of the fluid is divided between the plurality of modular heat exchangers 50A-50F. To increase the flow of fluid through the modular heating system 200, more modular heat exchangers 50 may be added to the modular heating system 200. Likewise, one or more modular heat exchangers 50 may be removed from the modular heating system 200 if the flow through the inlet pipeline 1 is lower than the expected flow through the current configuration of heat exchangers 50.

Figure 12:
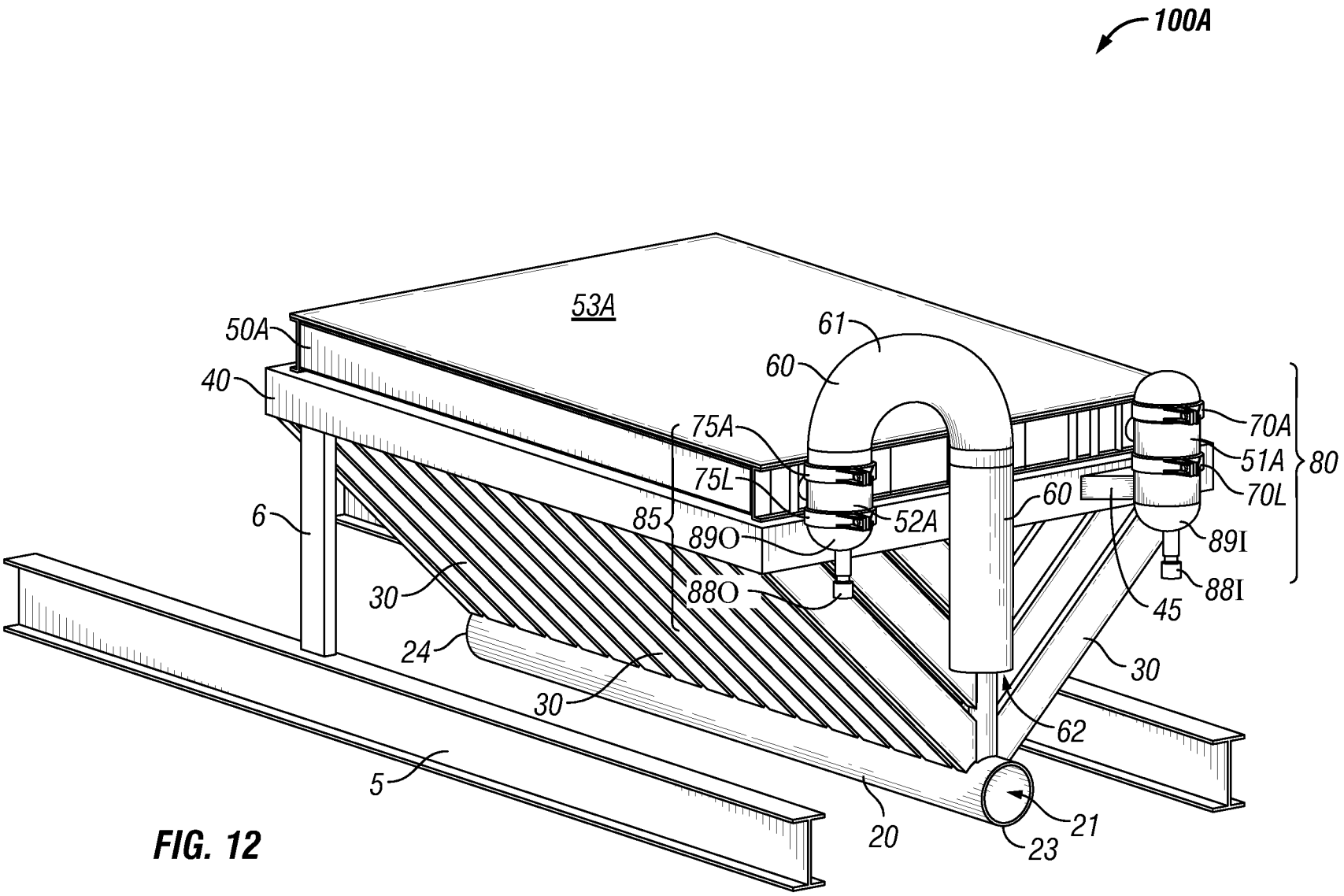
FIG. 12 is a perspective view of an embodiment of a modular heating unit that includes a single heat exchanger.

The exit flow path 60 of the modular heating system 200 may include a one-hundred-and-eighty-degree bend as shown at portion 61 between the upper modular heat exchanger 50F and the exit port 62 (shown in FIG. 12). At least one of the plurality of modular heat exchangers 50A-50F may have a perimeter having a first shape and at least one of the plurality of modular heat exchangers may have a perimeter having a second shape that differs from the first shape. For example, at least one of the plurality of modular heat exchangers 50A-50F may have a rectangular shape perimeter and at least one of the plurality of modular heat exchangers 50A-50F may have a different perimeter shape, such as but not limited to, a triangular shape. Various perimeter shapes may be used for heat exchangers 50 in the modular heating system 200 as long as the inlet and outlet rings 51 and 52 are configured to be connected together via a coupling.

Each of the plurality of heat exchangers 50A-50F may include an inlet ring 51A-51F, an inlet port 54 along the inlet ring 51A-51F, an outlet ring 52A-52F, and an outlet port 55 along the outlet ring 52A-52F, wherein the inlet rings 51A-51F are connected together by a plurality of couplings 70A-70E to form an external inlet pipe 80 and wherein the outlet rings 52A-52F are connected together via a plurality of couplings 75A-75E to form an external outlet pipe 85. The first flow path 45 may be fluidly coupled to the inlet ring 51A of the lower modular heat exchanger 50A. The external inlet pipe may 80 be closed at a first end 81 and may be closed at a second end 82 and the external outlet pipe 85 may be closed at a first end 86 and the exit flow path 60 may be fluidly connected to the second end 87 of the external outlet pipe 85 via a coupling 75U. The external inlet pipe 80 includes a domed cap 891 located at the first end 81 of the external inlet pipe 80. The external outlet pipe 85 includes a domed cap 890 located at the first end 86 of the external outlet pipe 85.

FIG. 12 shows a heating unit 100A that has a first heat exchanger 50A connected to the header 40. The heating unit 100A includes an external inlet pipe 80 and an external outlet pipe 85. The external inlet pipe 80 includes a domed end cap 891 connected to the first end 81 of the external inlet pipe 80. The external outlet pipe 85 includes a domed end cap 890 connected to the first end 86 of the external outlet pipe 85. The heating unit 100A includes a first heating element 881 connected to the domed end cap 891 and a second heating element 880 connected to the domed end cap 890. The first heating element 881 may be used to heat fluid located in the external inlet pipe 80 while fluid is not flowing through the heating unit 100A to prevent the fluid from freezing in cold weather. Likewise, the second heating element 880 may be used to heat fluid located in the external outlet pipe 85 while fluid is not flowing through the heating unit 100A to prevent the fluid from freezing in cold weather.

The modular heating unit 100 includes a first flow path 45 and an exit port 62. The first flow path 45 enables fluid to flow from the header 40 into the first heat exchanger 50A via the first inlet port along the first inlet ring 51A. The modular heating unit 100 includes an exit flow path 60 connected to the second end 87 of the external outlet pipe 85. The exit flow path 60 fluidly connects the first outlet port along the first outlet ring 52A to the exit port 62, wherein a portion 61 of the exit flow path 60 is positioned above the top surface the first heat exchanger 50A.

Figure 13:
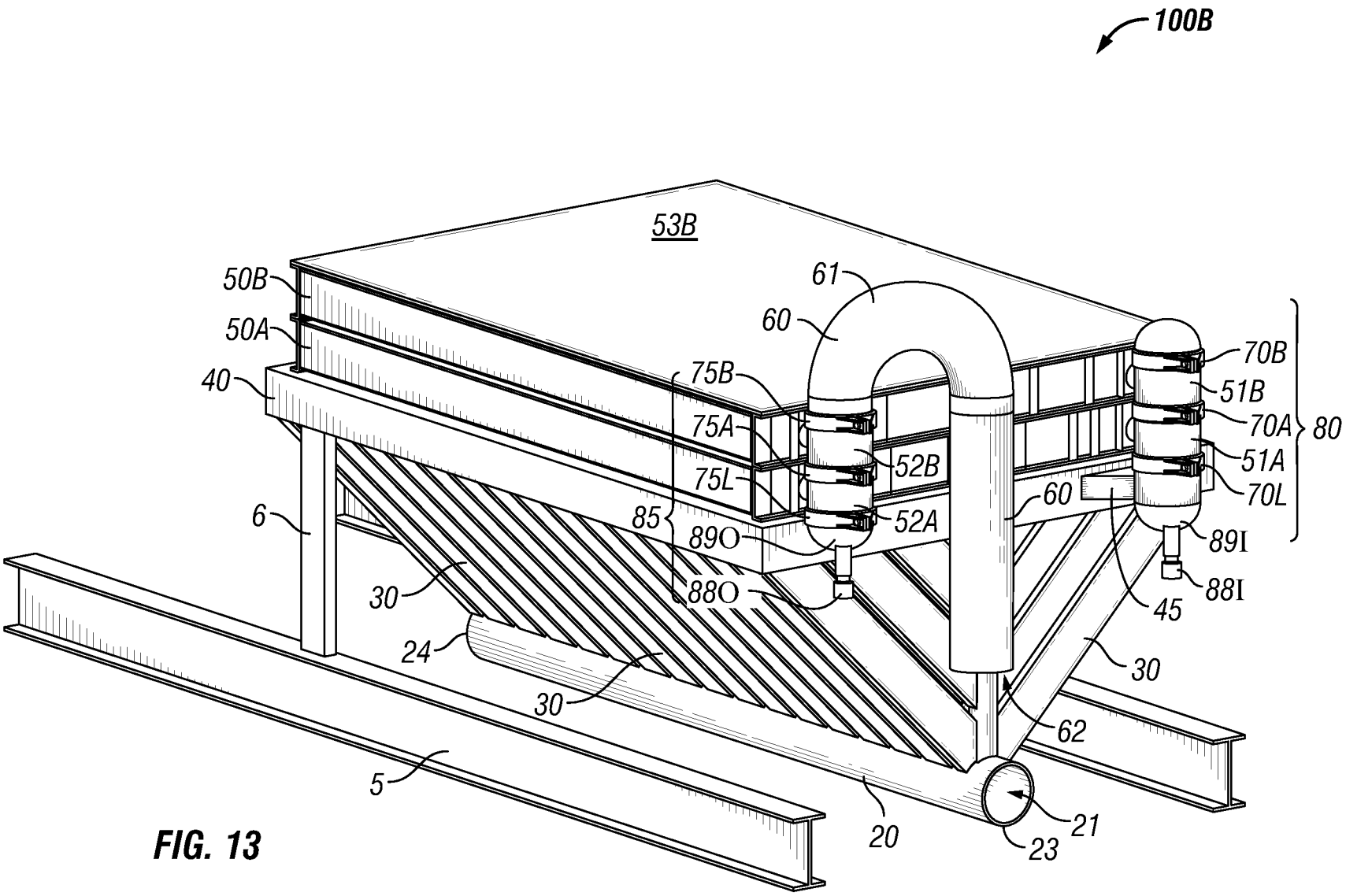
FIG. 13 is a perspective view of an embodiment of a modular heating unit that includes two heat exchangers.

FIG. 13 is a perspective view of an embodiment of a modular heating unit 100B that includes two heat exchangers 50A and 50B. The second heat exchanger 50B is connected to the first heat exchanger 50A. The second heat exchanger 50B comprises a top surface 53B, a bottom surface, a plurality of fins positioned between the top surface 53B and the bottom surface, a second inlet ring 51B, a second inlet port along the second inlet ring 51B, a second outlet ring 52B, and a second outlet port along the second outlet ring 52B.

The external outlet pipe 85 comprises the second outlet ring 52B, wherein fluid may flow from the second heat exchanger 50B to the exit port 62 via the second outlet port, the second outlet ring 52B, and the exit flow path 60. A portion of the exit flow path 60 is positioned above the top surface of the second heat exchanger 50B. The external inlet pipe 80 comprises the second inlet ring 51B, wherein fluid may enter into the second heat exchanger 50B via the first flow path 45, the first inlet ring 51A, the second inlet ring 51B, and the second inlet port.

Figure 14:
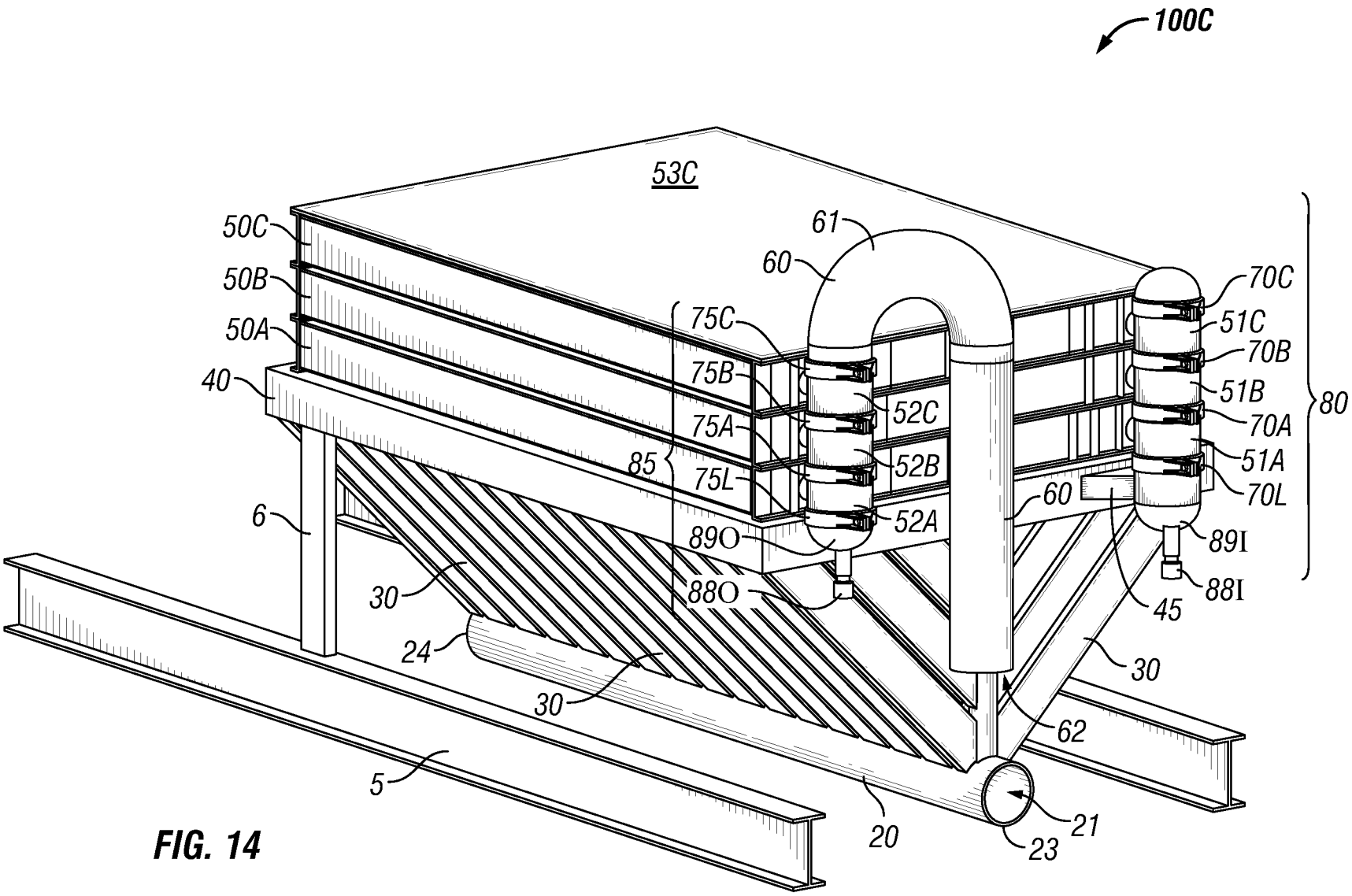
FIG. 14 is a perspective view of an embodiment of a modular heating unit that includes three heat exchangers.

FIG. 14 is a perspective view of an embodiment of a modular heating unit 100C that includes three heat exchangers 50A-50C. The modular heating unit 100C includes a third heat exchanger 50C connected to the second heat exchanger 50B. The third heat exchanger comprises a top surface 53C, a bottom surface, and a plurality of fins positioned between the top surface 53C and the bottom surface, a third inlet ring 51C, a third inlet port along the third inlet ring 51C, a third outlet ring 52C, and a third outlet port along the third outlet ring 52C.

The external inlet pipe 80 comprises the third inlet ring 51C, wherein fluid may enter into the third heat exchanger 50C via the first flow path 45, the first inlet ring 51A, the second inlet ring 51B, the third inlet ring 51C, and the third inlet port. The external outlet pipe 85 comprises the third outlet ring 52C, wherein fluid may flow from the third heat exchanger 50C to the exit port 62 via the third outlet port, the third outlet ring 52C, and the exit flow path 60. A portion 61 of the exit flow path 60 is positioned above the top surface 53C of the third heat exchanger 50C.

Figure 15:
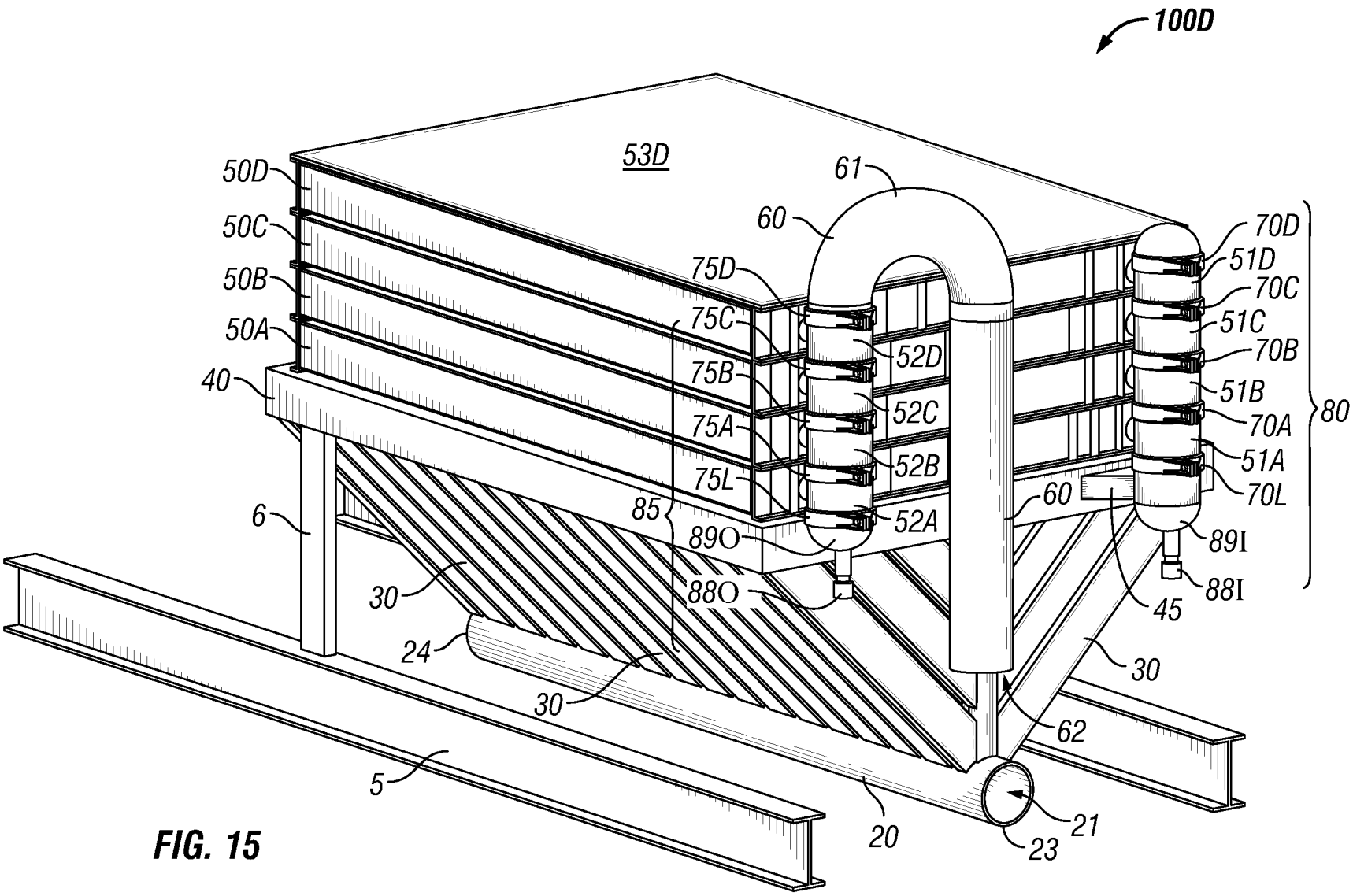
FIG. 15 is a perspective view of an embodiment of a modular heating unit that includes four heat exchangers.

FIG. 15 is a perspective view of an embodiment of a modular heating unit 100D that includes four heat exchangers 50A-50D. The modular heating unit 100D includes a fourth heat exchanger 50D connected to the third heat exchanger 50C. The fourth heat exchanger 50D comprises a top surface 53D, a bottom surface, and a plurality of fins positioned between the top surface 53D and the bottom surface, a fourth inlet ring 51D, a fourth inlet port along the fourth inlet ring 51D, a fourth outlet ring 52D, and a fourth outlet port along the fourth outlet ring 52D.

The external inlet pipe 80 comprises the fourth inlet ring 51C, wherein fluid may enter into the fourth heat exchanger 50D via the first flow path 45, the first inlet ring 51A, the second inlet ring 51B, the third inlet ring 51C, the fourth inlet ring 51D, and the fourth inlet port. The external outlet pipe 85 comprises the fourth outlet ring 52D, wherein fluid may flow from the fourth heat exchanger 50D to the exit port 62 via the fourth outlet port, the fourth outlet ring 52D, and the exit flow path 60. A portion 61 of the exit flow path 60 is positioned above the top surface 53D of the fourth heat exchanger 50D.

Figure 16:
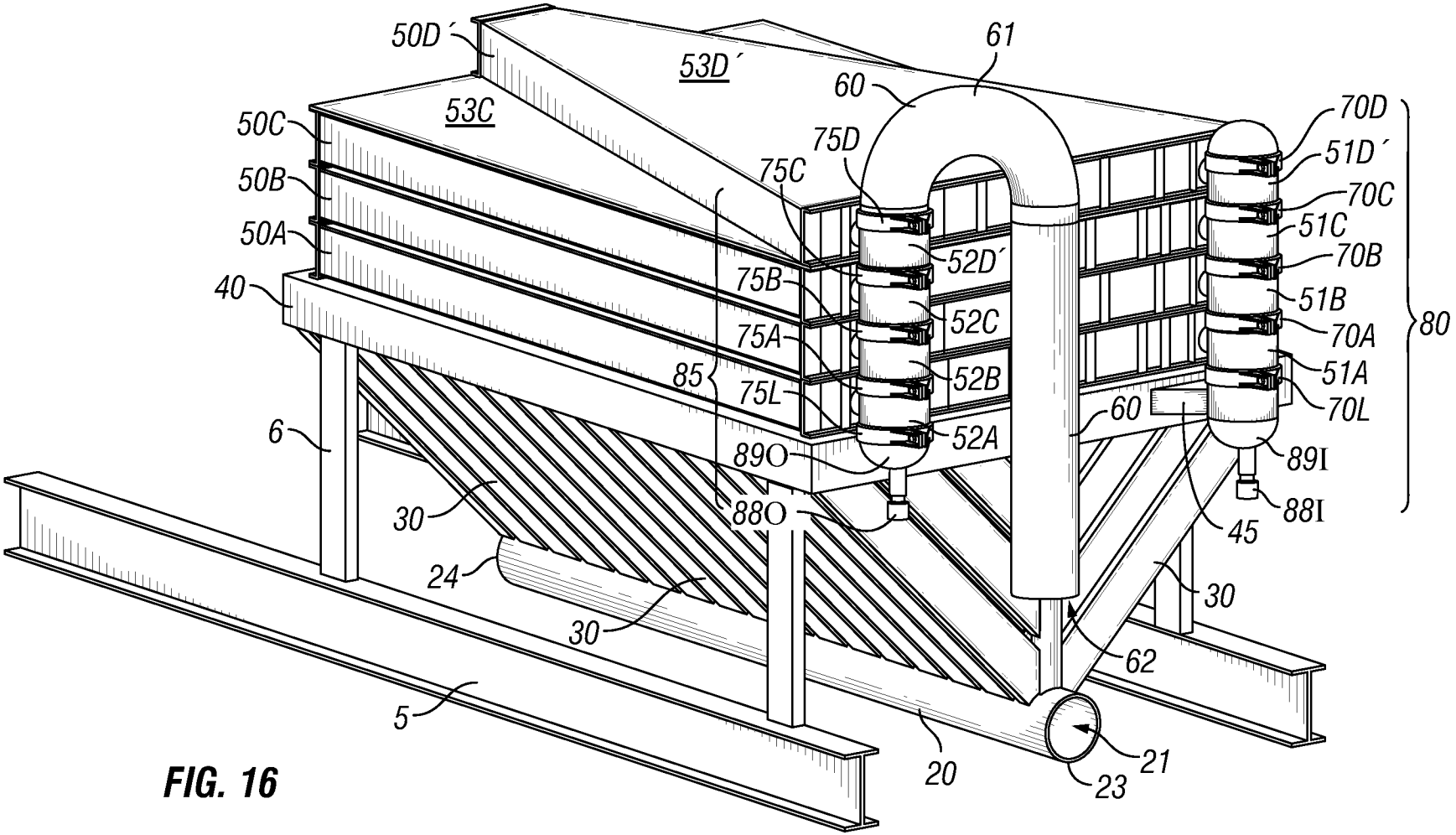
FIG. 16 is a perspective view of an embodiment of a modular heating unit that includes heat exchangers having differing perimeter shapes.

FIG. 16 is a perspective view of an embodiment of a modular heating unit 100D' that includes four heat exchangers 50A-50D'. The modular heating unit 100D' includes a fourth heat exchanger 50D' connected to the third heat exchanger 50C. The fourth heat exchanger 50D' comprises a top surface 53D', a bottom surface, and a plurality of fins positioned between the top surface 53D' and the bottom surface, a fourth inlet ring 51D', a fourth inlet port along the fourth inlet ring 51D', a fourth outlet ring 52D', and a fourth outlet port along the fourth outlet ring 52D'.

The external inlet pipe 80 comprises the fourth inlet ring 51C, wherein fluid may enter into the fourth heat exchanger 50D' via the first flow path 45, the first inlet ring 51A, the second inlet ring 51B, the third inlet ring 51C, the fourth inlet ring 51D, ' and the fourth inlet port. The external outlet pipe 85 comprises the fourth outlet ring 52D', wherein fluid may flow from the fourth heat exchanger 50D' to the exit port 62 via the fourth outlet port, the fourth outlet ring 52D', and the exit flow path 60. A portion 61 of the exit flow path 60 is positioned above the top surface 53D' of the fourth heat exchanger 50D'. The fourth heat exchanger 50D' has a perimeter shape that is triangular where the other heat exchangers 50A-50C have a perimeter shape that is rectangular.

Figure 17:
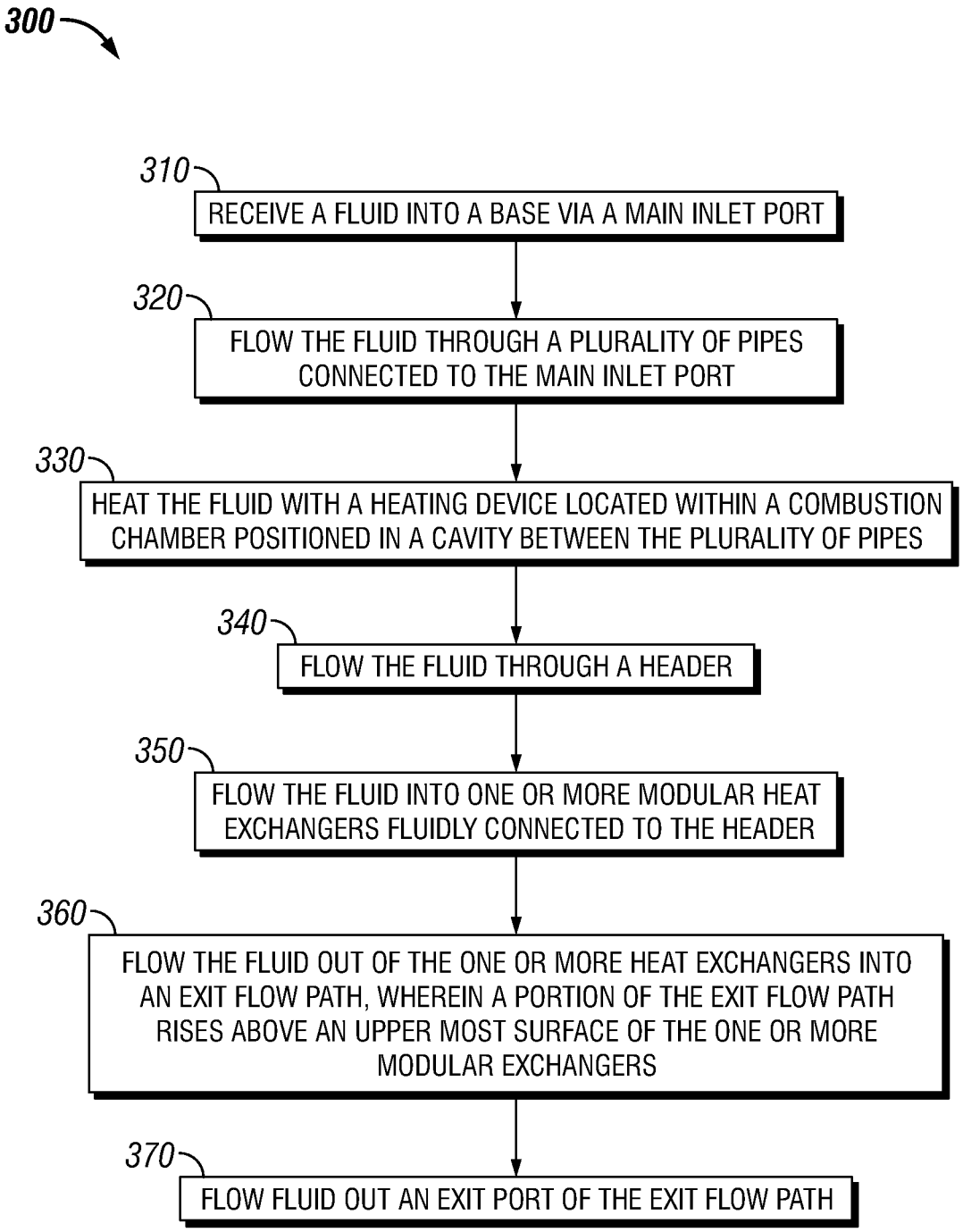
FIG. 17 is a flow chart showing one embodiment of a method of the present disclosure.

FIG. 17 is a flow chart showing an embodiment of a method 300 of the present disclosure. The method 300 includes receiving a fluid into a base via a main inlet port, at 310. For example, the main inlet port 21 of a main inlet pipe 20 may be connected to an inlet pipeline 1 and may receive the entire flow of the inlet pipeline 1. The method 300 includes flowing the fluid through a plurality of pipes connected to the main inlet port, at 320. For example, a plurality of pipes 30 may be connected to the main inlet pipe 20 and fluid flowing through the main inlet pipe 20 flows into the plurality of pipes 30. The method 300 includes heating the fluid with a heating device located within a combustion chamber positioned in a cavity between the plurality of pipes, at 330. For example, a burner may be positioned within a combustion chamber within the plurality of pipes 30 to heat fluid flowing the plurality of pipes 30.

The method 300 includes flowing the fluid through a header, at 340. For example, fluid flowing through a plurality of pipes 30 may flow into a header 40. The method 300 includes flowing the fluid into one or more modular heat exchanger fluidly connected to the header, at 350. For example, one or more heat exchangers 50 may be fluidly connected to the header 40 and fluid from the header 40 may flow through the one or more heat exchangers 50. The method 300 includes flowing the fluid out of the one or more heat exchangers into an exit flow path, wherein a portion of the exit flow path rises about an upper most surface of the one or more modular heat exchangers, at 360. For example, an exit flow path 60 may be fluidly connected to the outputs of the one or more modular heat exchangers 50. The exit flow path 60 may include a one-hundred-and-eighty-degree bend that rises beyond the top surface of the upper most heat exchanger 50. The method 300 includes flowing fluid out an exit port of the exit flow path, at 370. For example, the exit flow path 60 includes an exit port 62 at the end of the exit flow path 60. An outlet pipeline 2 may be connected to the exit port 62 of the flow path 60.

Figure 18:
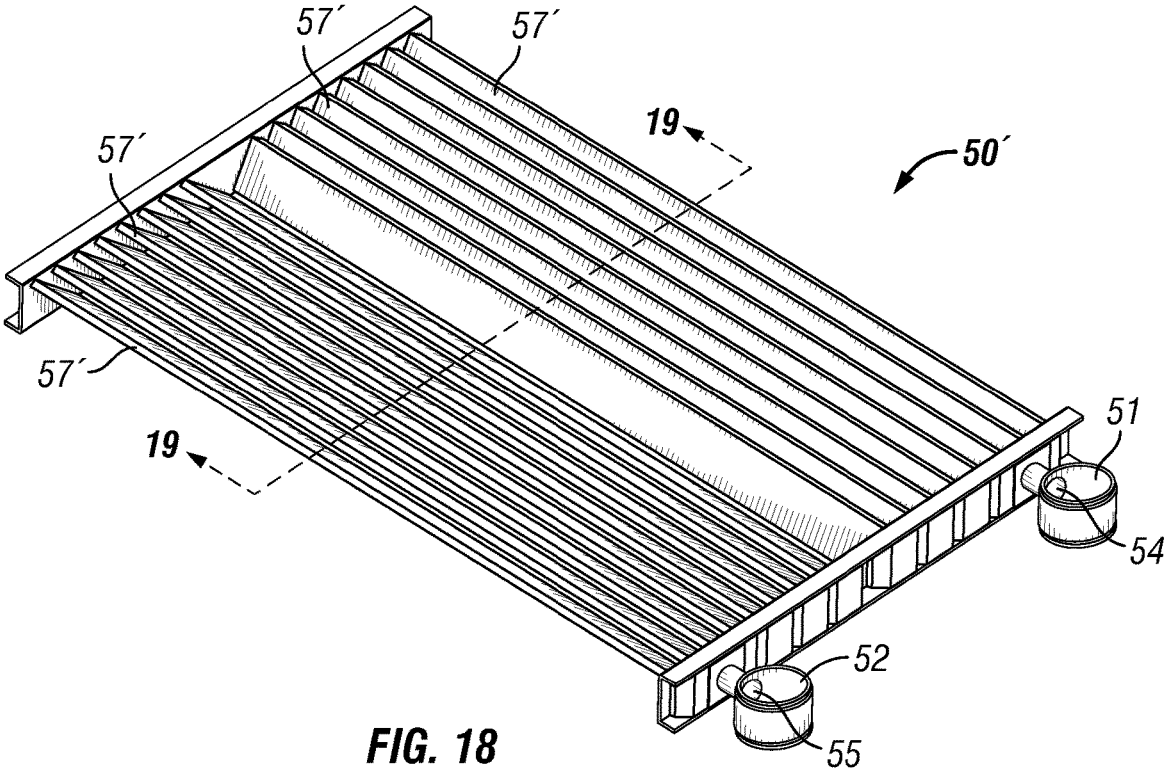
FIG. 18 is a perspective view of an embodiment of a modular heat exchanger.
Figure 19:
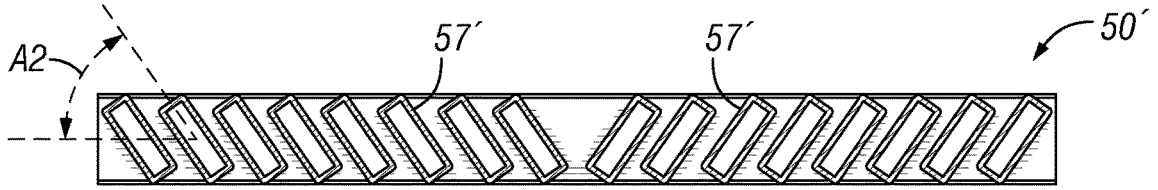
FIG. 19 is a partial cross-section view of an embodiment of a modular heat exchanger.

FIG. 18 is a perspective view of an embodiment of a modular heat exchanger 50'. FIG. 19 is a partial cross-section view of an embodiment of a modular heat exchanger 50'. The top surface of the modular heat exchanger 50' is not shown for clarity. The modular heat exchanger 50' includes a plurality of fins 57' located internally. That is, the plurality of fins 57' are positioned between the top surface and the bottom surface of the modular heat exchanger 50'. The modular heat exchanger 50' includes an inlet ring 51 and an outlet ring 52. The inlet and outlet rings 51, 52 may be connected to other modular heat exchangers via a fluidic coupling. Various fluidic couplings may be used to connect modular heat exchangers together as part of a modular heating unit 100 as would be appreciated by one of ordinary skill in the art having the benefit of this disclosure. For example, the fluidic coupling may be, but is not limited to, a VICTAULIC pipe coupling offered commercially by Victaulic of Easton, Pennsylvania. The modular heat exchanger 50' includes an inlet port 54 positioned along inlet ring 51 that lets fluid enter the modular heat exchanger 50' and flow along the fins and out an outlet port 55 positioned along the outlet ring 52 that enables fluid to flow out of the modular heat exchanger 50'.

As shown in FIGS. 18 and 19, each of the plurality of fins 57' of the heat exchanger 50' may not be substantially vertical with respect to the bottom surface of the heat exchanger 50'. For example, the fins 57' of the heat exchanger 50' may form an angle that is seventy-five degrees or less with regard to the bottom surface of the heat exchanger 50'. In one embodiment each of the plurality of fins 57' of the heat exchanger 50' may form an angle A2 of approximately thirty-three degrees with respect to the bottom surface of the heat exchanger 50'. As used herein, approximately thirty-three degrees means ±5 degrees. In other words, in one embodiment each of the plurality of fins 57' of the heat exchanger 50' may form an angle A2 of between 28 and 38 degrees with respect to the bottom surface of the heat exchanger 50'.

Figure 20:
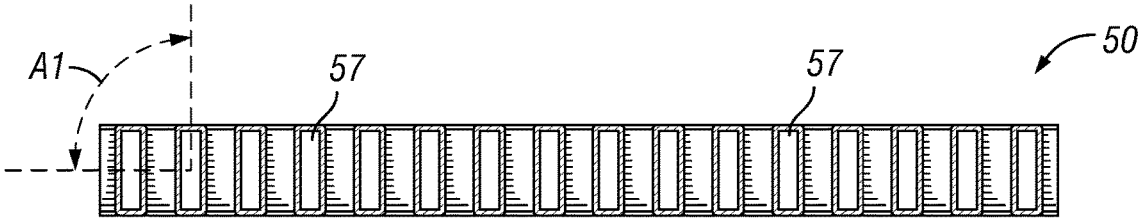
FIG. 20 is a partial cross-section view of an embodiment of a modular heat exchanger.

FIG. 20 is a partial cross-section view of an embodiment of a modular heat exchanger 50. As shown in FIG. 20, each of the plurality of fins 57 of the heat exchanger 50 may be substantially vertical to form an angle A1 of approximately ninety degrees with respect to the bottom surface of the heat exchanger 50. As used herein, approximately ninety degrees means ±5 degrees. In other words, in one embodiment each of the plurality of fins 57 of the heat exchanger 50 may form an angle A1 of between 85 and 95 degrees with respect to the bottom surface of the heat exchanger 50.

Although this disclosure has been described in terms of certain examples, other examples that are apparent to those of ordinary skill in the art, including examples that do not provide all of the features and advantages set forth herein, are also within the scope of this disclosure. Accordingly, the scope of the present disclosure is defined only by reference to the appended claims and equivalents thereof

What is claimed is:

1. A modular heating unit comprising:

a base member, the base member comprising:

a main inlet pipe having an inlet port;

a header, the header including a plurality of output ports;

a plurality of pipes fluidly connect the main inlet pipe with the header;

a combustion chamber within the plurality of pipes and the header; and an external opening through the pipes that provides access to the combustion chamber;

a first heat exchanger connected to the header, the first heat exchanger having a top surface, a bottom surface, a plurality of fins positioned between the top surface and the bottom surface, a first inlet ring, a first inlet port located along the first inlet ring, a first outlet ring, and a first outlet port located along the first outlet ring;

an external inlet pipe having a first end and a second end, the first end being closed, and the second end being closed, wherein the external inlet pipe comprises the first inlet ring;

an external outlet pipe having a first end and a second end, the first end being closed and the second end being open, wherein the external outlet pipe comprises the first outlet ring;

a first flow path, the first flow path enables fluid to flow from the header into the first heat exchanger via the first inlet port along the first inlet ring;

an exit port;

an exit flow path connected to the second end of the external outlet pipe, the exit flow path fluidly connects the first outlet port along the first outlet ring to the exit port, wherein a portion of the exit flow path is positioned above the top surface the first heat exchanger;

a second heat exchanger connected to the first heat exchanger, the second heat exchanger having a top surface, a bottom surface, a plurality of fins positioned between the top surface and the bottom surface, a second inlet ring, a second inlet port along the second inlet ring, a second outlet ring, and a second outlet port along the second outlet ring;

the external inlet pipe comprises the second inlet ring, wherein fluid may enter into the second heat exchanger via the first flow path, the first inlet ring, the second inlet ring, and the second inlet port;

the external outlet pipe comprises the second outlet ring, wherein fluid may flow from the second heat exchanger to the exit port via the second outlet port, the second outlet ring, and the exit flow path; and wherein a portion of the exit flow path is positioned above the top surface of the second heat exchanger.

2. The modular heating unit of claim 1, wherein each of the plurality of fins are substantially vertical to form an angle of approximately ninety degrees with respect to the bottom surface.

3. The modular heating unit of claim 1, wherein each of the plurality of fins are not substantially vertical with respect to the bottom surface.

4. The modular heating unit of claim 3, wherein each of the plurality of fins form an angle of approximately thirty-three degrees with respect to the bottom surface.

5. The modular heating unit of claim 1, wherein the first heat exchanger has a first perimeter having a first shape and the second heat exchanger has a second perimeter having a second shape that differs from the first shape.

6. The modular heating unit of claim 1, further comprising:

a lower inlet coupling that fluidly connects the first flow path to the first inlet ring;

a first inlet coupling that fluidly connects the first inlet ring to the second inlet ring;

a first outlet coupling that fluidly connects the first outlet ring to the second outlet ring;

an upper outlet coupling that fluidly connects the second end of the external outlet pipe to the exit flow path;

wherein fluid may flow from the header and into the first heat exchanger via the first flow path, the lower inlet coupling, the first inlet ring, and the first inlet port;

wherein fluid may flow from the header and into the second heat exchanger via the first flow path, the lower inlet coupling, the first inlet ring, the first inlet coupling, the second inlet ring, and the second inlet port;

wherein fluid may flow from the first heat exchanger to the exit port via the first outlet port, the first outlet ring, the first outlet coupling, the second outlet ring, the upper outlet coupling, and the exit flow path; and wherein fluid may flow from the second heat exchanger to the exit port via the second outlet port, the second outlet ring, the upper outlet coupling, and the exit flow path.

7. The modular heating unit of claim 6, comprising:

wherein the lower inlet coupling, the first inlet ring, the first inlet coupling, and the second inlet ring form the external inlet pipe; and wherein the first outlet ring, the first outlet coupling, the second outlet ring, and the upper outlet coupling form the external outlet pipe.

8. The modular heating unit of claim 7, comprising:

a first heating element connected to the first end of the external inlet pipe; and a second heating element connected to the first end of the external outlet pipe.

9. The modular heating unit of claim 8, comprising:

a domed end cap; and a lower outlet coupling that connects the domed end cap to the first outlet ring, wherein the second heating element is connected to the domed end cap.

10. The modular heating unit of claim 7, comprising:

a third heat exchanger connected to the second heat exchanger, the third heat exchanger having a top surface, a bottom surface, and a plurality of fins positioned between the top surface and the bottom surface, a third inlet ring, a third inlet port along the third inlet ring, a third outlet ring, and a third outlet port along the third outlet ring;

the external inlet pipe comprises the third inlet ring, wherein fluid may enter into the third heat exchanger via the first flow path, the first inlet ring, the second inlet ring, the third inlet ring, and the third inlet port;

the external outlet pipe comprises the third outlet ring, wherein fluid may flow from the third heat exchanger to the exit port via the third outlet port, the third outlet ring, and the exit flow path; and wherein a portion of the exit flow path is positioned above the top surface of the third heat exchanger.

11. The modular heating unit of claim 10, comprising:

a second inlet coupling that connects the third inlet ring to the second inlet ring;

a second outlet coupling that connects the third outlet ring to the second outlet ring;

wherein fluid may flow from the header and into the third heat exchanger via the first flow path, the lower inlet coupling, the first inlet ring, the first inlet coupling, the second inlet ring, the second inlet coupling, the third inlet ring, and the third inlet port;

wherein fluid may flow from the first heat exchanger to the exit port via the first outlet port, the first outlet ring, the first outlet coupling, the second outlet ring, the second outlet coupling, the third outlet ring, the upper outlet coupling, and the exit flow path;

wherein fluid may flow from the second heat exchanger to the exit port via the second outlet port, the second outlet ring, the second outlet coupling, the third outlet ring, the upper outlet coupling, and the exit flow path; and wherein fluid may flow from the third heat exchanger to the exit port via the third outlet port, the third outlet ring, the upper outlet coupling, and the exit flow path.

* * * * *